US010135197B2

(12) United States Patent
Little et al.

(10) Patent No.: US 10,135,197 B2
(45) Date of Patent: Nov. 20, 2018

(54) ELECTRICAL CONNECTOR HAVING COMMON GROUNDING

(71) Applicant: FOXCONN INTERCONNECT TECHNOLOGY LIMITED, Grand Cayman (KY)

(72) Inventors: Terrance F. Little, Fullerton, CA (US); Chih-Hsien Chou, San Jose, CA (US); Jim Zhao, Irvine, CA (US); An-Jen Yang, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/715,083

(22) Filed: Sep. 25, 2017

(65) Prior Publication Data

US 2018/0090887 A1 Mar. 29, 2018

Related U.S. Application Data

(60) Provisional application No. 62/399,272, filed on Sep. 23, 2016, provisional application No. 62/412,841, filed on Oct. 26, 2016.

(51) Int. Cl.

| | |
|---|---|
| ***H01R 13/6585*** | (2011.01) |
| ***H01R 13/6594*** | (2011.01) |
| ***H01R 12/58*** | (2011.01) |
| ***H01R 12/72*** | (2011.01) |

(52) U.S. Cl.
CPC ..... *H01R 13/6585* (2013.01); *H01R 12/58* (2013.01); *H01R 12/724* (2013.01); *H01R 13/6594* (2013.01)

(58) Field of Classification Search
CPC . H01R 13/6594; H01R 13/6585; H01R 12/58
See application file for complete search history.

(56) References Cited

U.S. PATENT DOCUMENTS

| | | | | |
|---|---|---|---|---|
| 5,141,445 | A * | 8/1992 | Little | H01R 12/57 439/108 |
| 7,402,077 | B2 | 7/2008 | Shindo | |
| 7,758,380 | B2 * | 7/2010 | Wang | H01R 27/02 439/541.5 |
| 8,142,207 | B1 | 3/2012 | Ljubijankic et al. | |
| 8,337,249 | B2 * | 12/2012 | Lappoehn | H01R 13/6585 439/607.55 |
| 8,540,525 | B2 | 9/2013 | Regnier et al. | |

(Continued)

*Primary Examiner* — Briggitte R Hammond
(74) *Attorney, Agent, or Firm* — Wei Te Chung; Ming Chieh Chang

(57) ABSTRACT

An electrical connector includes an insulative housing defining a front cavity for receiving a plug and a rear cavity, a terminal assembly assembled in the rear cavity, and a ground member. The terminal assembly includes an upper terminal module, a lower terminal module, and a shielding module sandwiched therebetween. The upper terminal module includes a pair of upper ground terminals. The lower terminal module includes a pair of lower ground terminals. The shielding module includes a metallic shielding plate. The ground member is associated with the shielding module to mechanically and electrically connect at least one of the upper ground terminals and the lower ground terminals with the shielding plate.

20 Claims, 48 Drawing Sheets

(56) References Cited

U.S. PATENT DOCUMENTS

| | | | | |
|---|---|---|---|---|
| 8,764,460 | B2 | 7/2014 | Smink et al. | |
| 8,764,464 | B2 | 7/2014 | Buck et al. | |
| 8,764,488 | B2 * | 7/2014 | Zeng | H01R 13/6585 439/108 |
| 8,808,029 | B2 | 8/2014 | Castillo et al. | |
| 8,858,243 | B2 * | 10/2014 | Luo | H01R 13/652 439/108 |
| 8,944,849 | B1 * | 2/2015 | Yang | H01R 13/6588 439/607.07 |
| 9,401,570 | B2 | 7/2016 | Phillips et al. | |
| 9,431,768 | B1 | 8/2016 | Champion et al. | |
| 9,531,129 | B2 | 12/2016 | de Boer | |
| 9,640,915 | B2 | 5/2017 | Phillips et al. | |
| 9,653,849 | B2 * | 5/2017 | Hsu | H01R 13/6584 |

* cited by examiner

ELECTRICAL CONNECTOR HAVING COMMON GROUNDING

BACKGROUND OF THE INVENTION

1. Field of the Invention

The invention relates to an electrical connector, and particularly to the electrical connector adapted for transmitting high speed signal.

2. Description of Related Art

Currently high speed electrical connector has a plurality of electrical lanes. Each of the electrical lanes may run at the rate of 25 Gbit/s or 50 Gbit/s. U.S. Pat. No. 8,764,464, issued to Buck et al., on Jul. 1, 2014, discloses example electrical connectors including a plurality of electrical contacts configured to communicate between electrical devices. The plurality of electrical contacts includes a plurality of ground contacts. A ground coupling assembly or grounding bar is configured to electrically connect or common ground contacts of an electrical connector to adjust a performance characteristic of the electrical connector as desired.

SUMMARY OF THE INVENTION

An object of the present invention, is to provide an electrical connector having means to transmit high speed signal.

To achieve the above-mentioned object, an electrical connector comprising an insulative housing defining a front cavity for receiving a plug and rear cavity opposite to said front cavity in a front-to-back direction; a terminal assembly assembled in the rear cavity and including an upper terminal module, a lower terminal module sandwiching a shielding module therebetween in a vertical direction perpendicular to said front-to-back direction, said upper terminal module including a plurality of upper terminals integrally formed with an upper insulator, said upper terminals comprising a pair of upper ground terminals and a pair of upper differential signal terminals disposed between the pair of upper ground terminals, said lower terminal module including a plurality of lower terminals integrally formed with a lower insulator, said lower terminals comprising a pair of lower ground terminals and a pair of lower differential signal terminals disposed between the pair of lower ground terminals, said shielding module including metallic shielding plate; wherein a ground member is associated with the shielding module to mechanically and electrically connect at least one of the upper ground terminals and the lower ground terminals with the shielding plate.

Other objects, advantages and novel features of the invention will become more apparent from the following detailed description when taken in conjunction with the accompanying drawings.

DETAILED DESCRIPTION OF THE PREFERRED EMBODIMENT

Figure 1A:
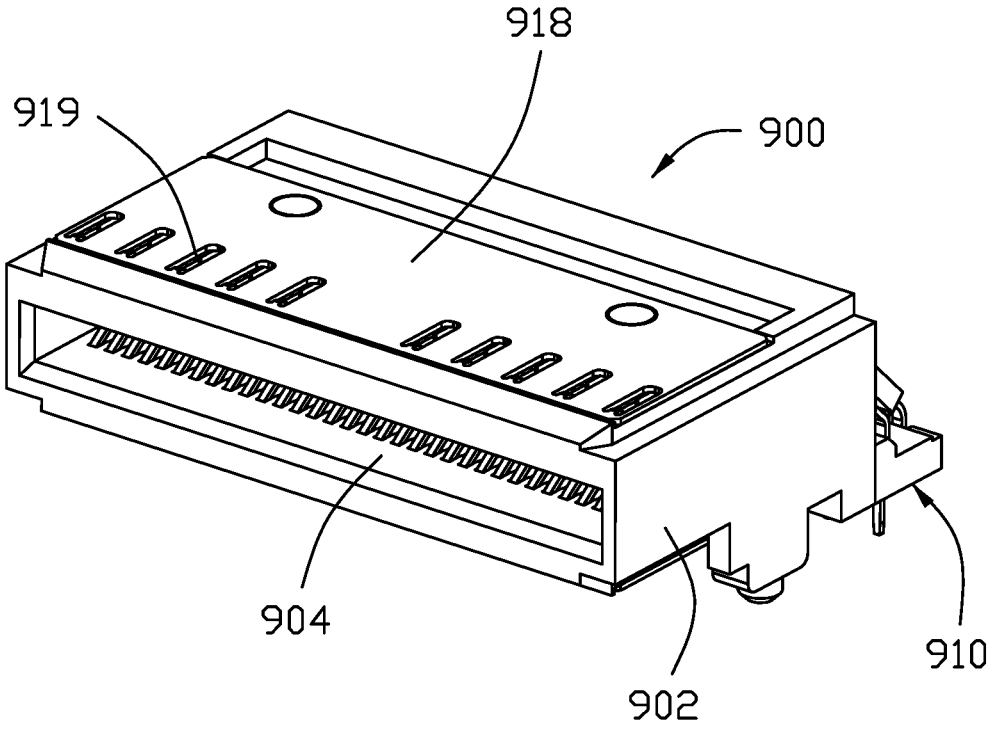
FIG. 1(A) is a front downward perspective view of the receptacle connector used with a plug cable connector according to a first embodiment of the invention.
Figure 1B:
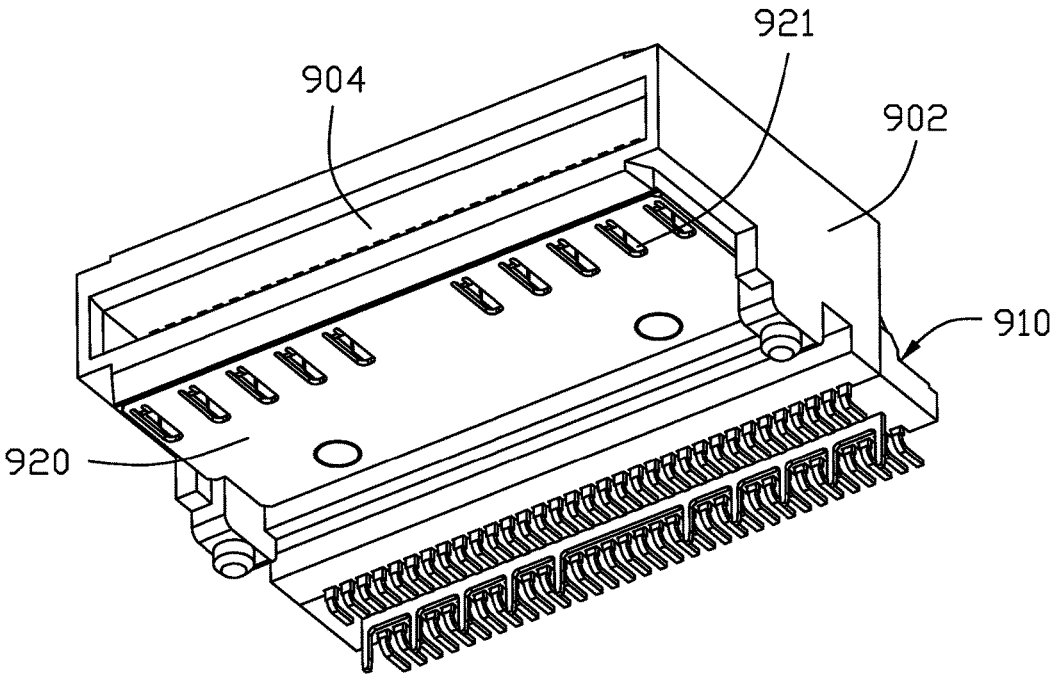
FIG. 1(B) is a rear upward perspective view of the receptacle connector of FIG. 1(A)
Figure 2A:
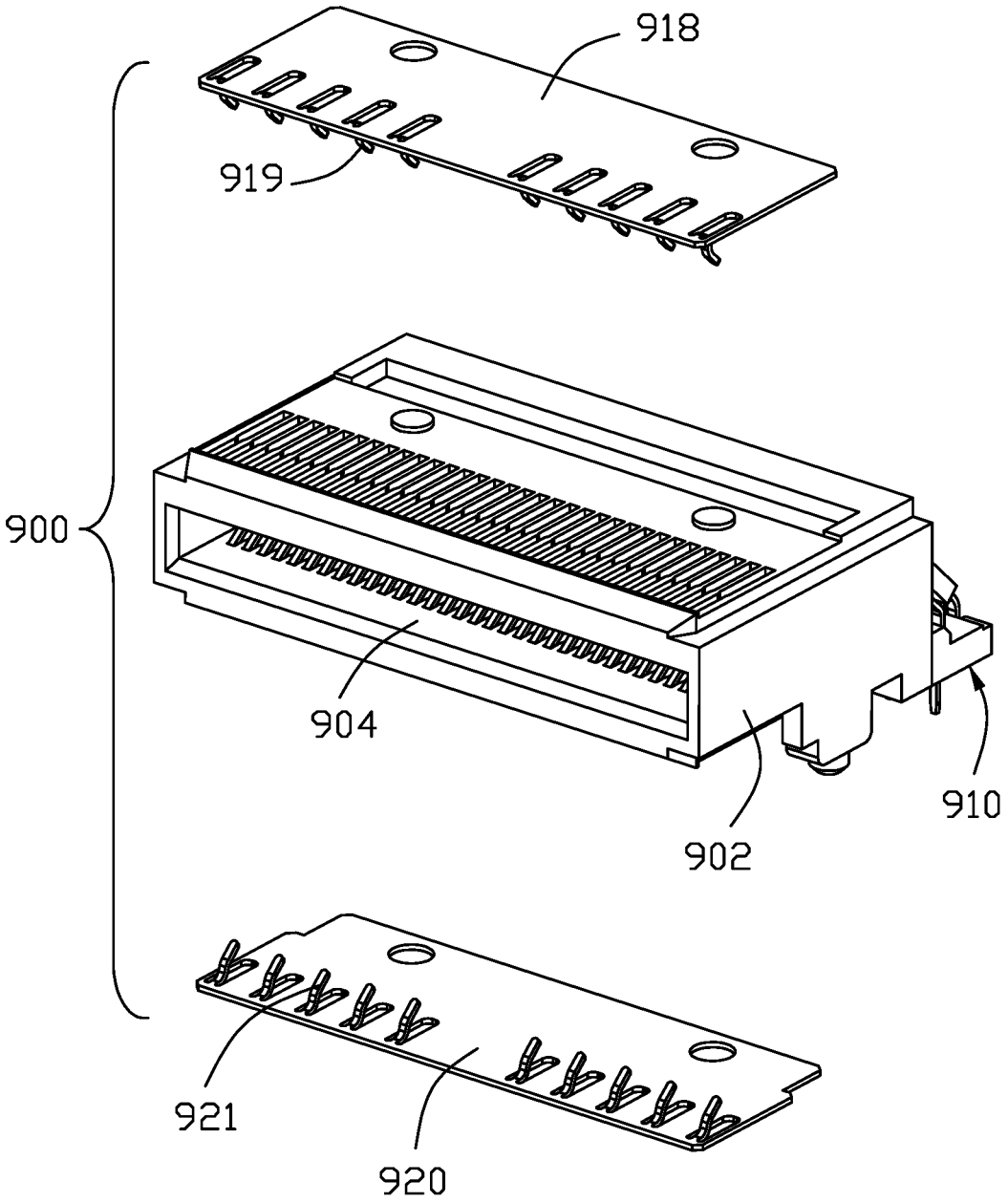
FIG. 2(A) is a front downward exploded perspective view of the receptacle connector of FIG. 1(A)
Figure 2B:
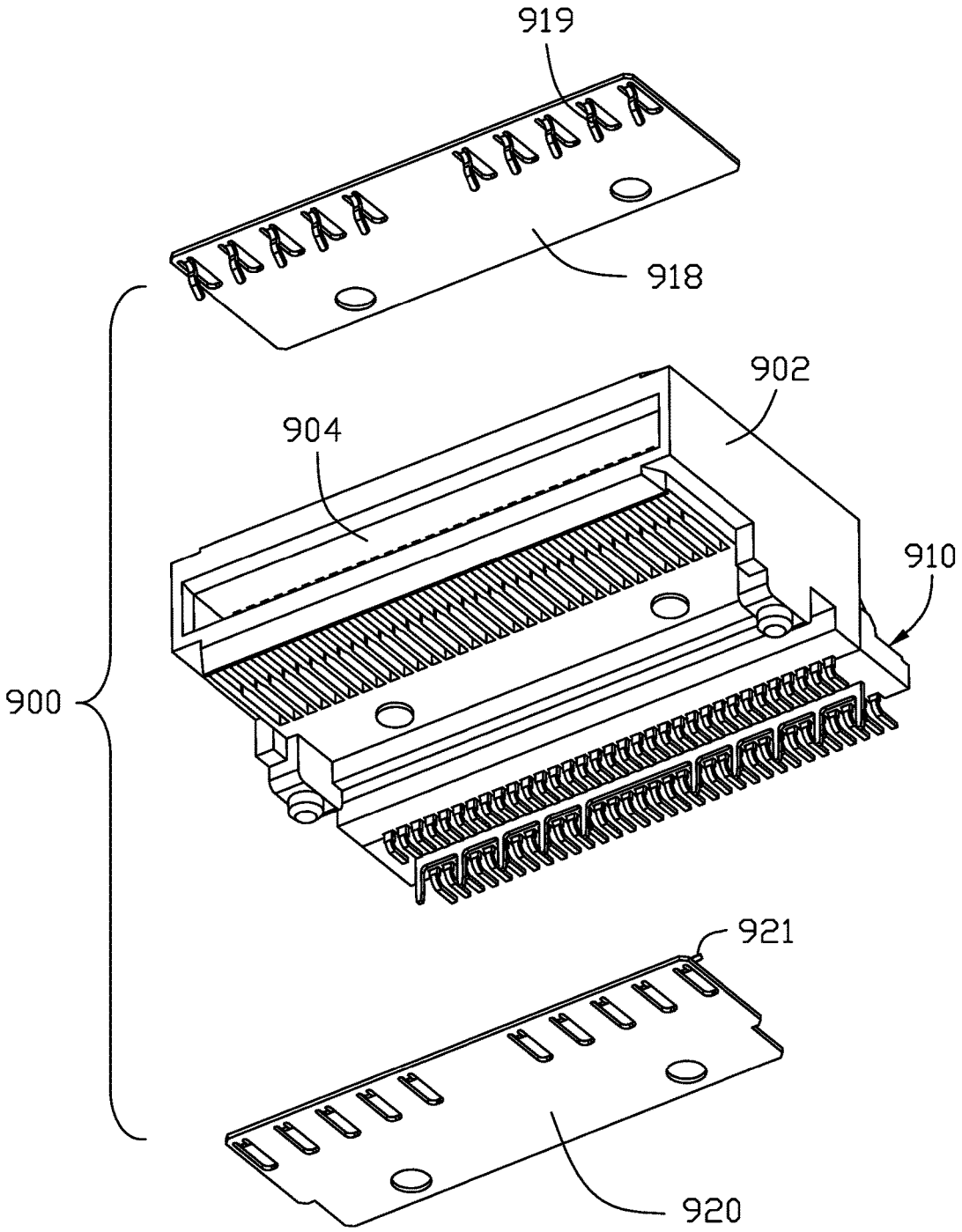
FIG. 2(B) is a rear upward perspective view of the receptacle connector of FIG. 2(A)
Figure 3A:
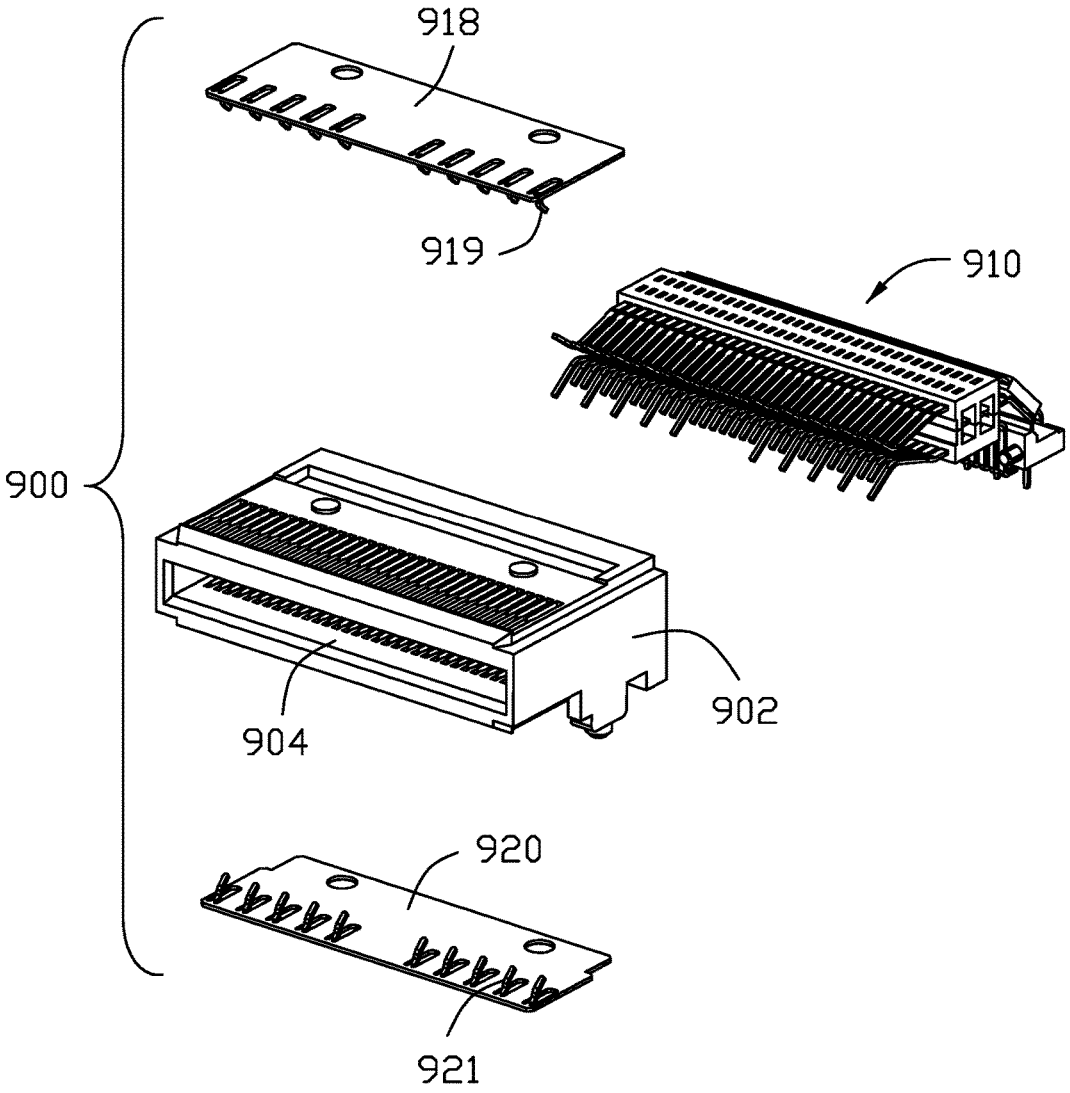
FIG. 3(A) is a front downward further exploded perspective view of the receptacle connector of FIG. 2(A)
Figure 3B:
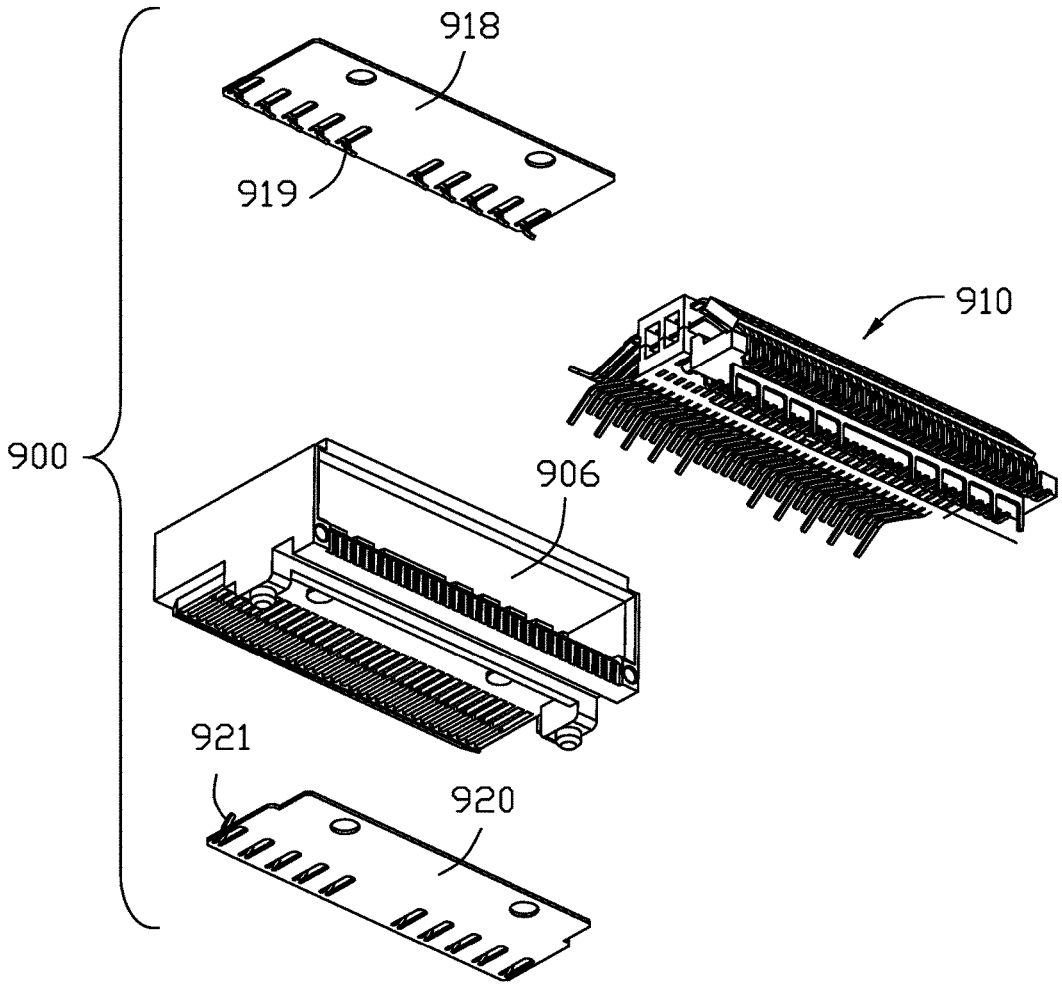
FIG. 3(B) is a rear upward further exploded perspective view of the receptacle connector of FIG. 2(A)
Figure 4A:
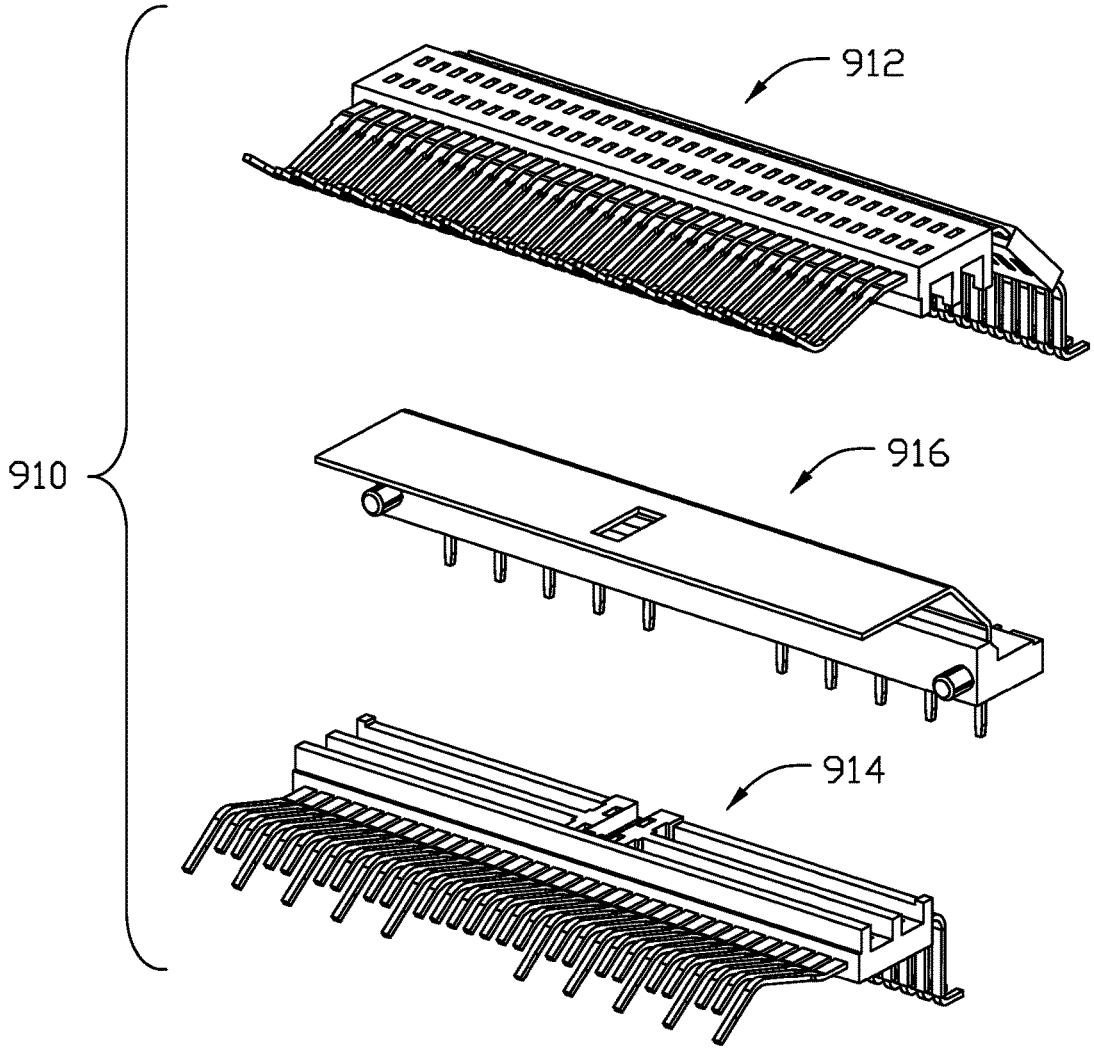
FIG. 4(A) is a front downward exploded perspective view of the terminal assembly of the receptacle connector of FIG. 1(A)
Figure 4B:
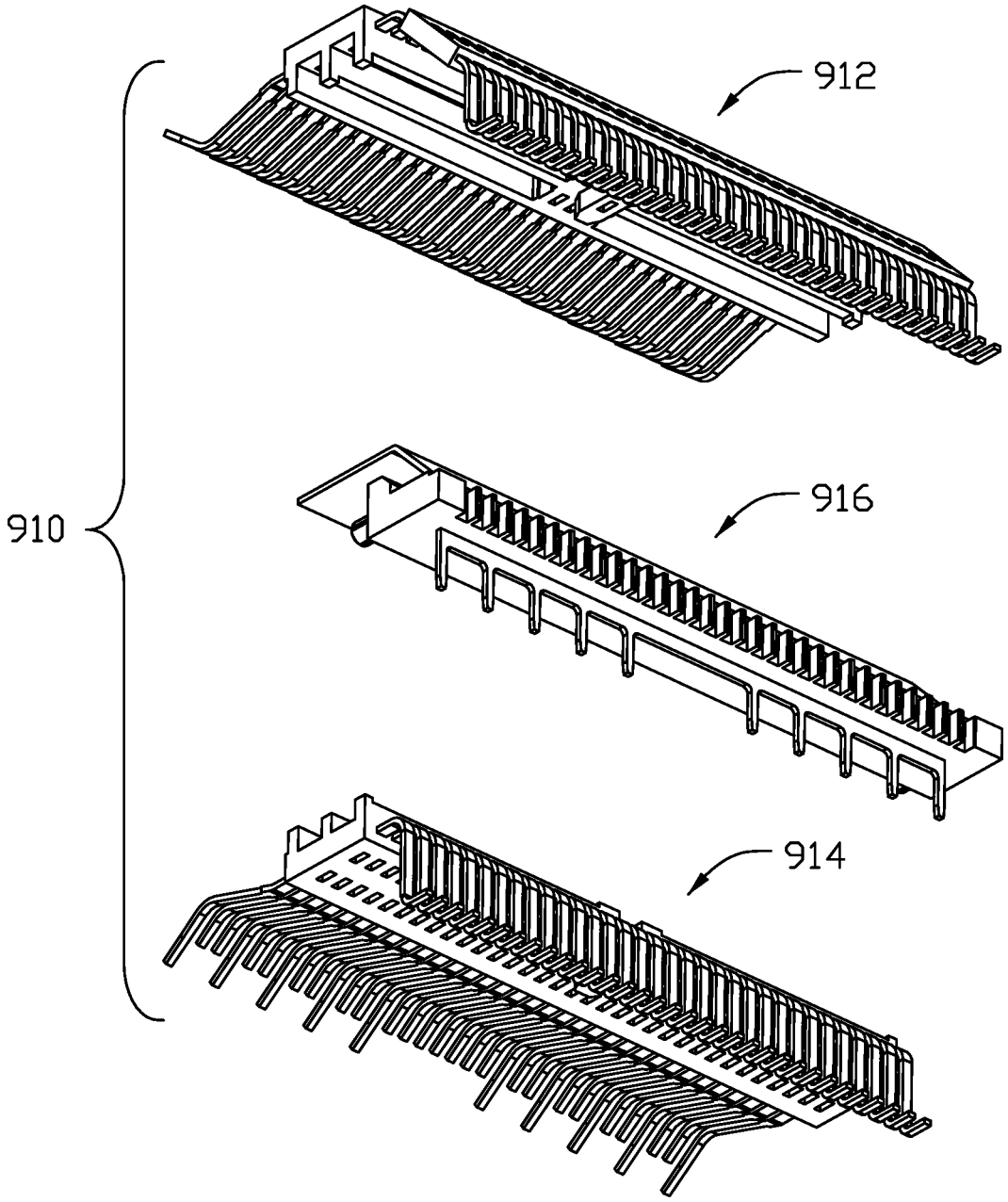
FIG. 4(B) is a rear upward exploded perspective view of the terminal assembly of FIG. 4(A)
Figure 5A:
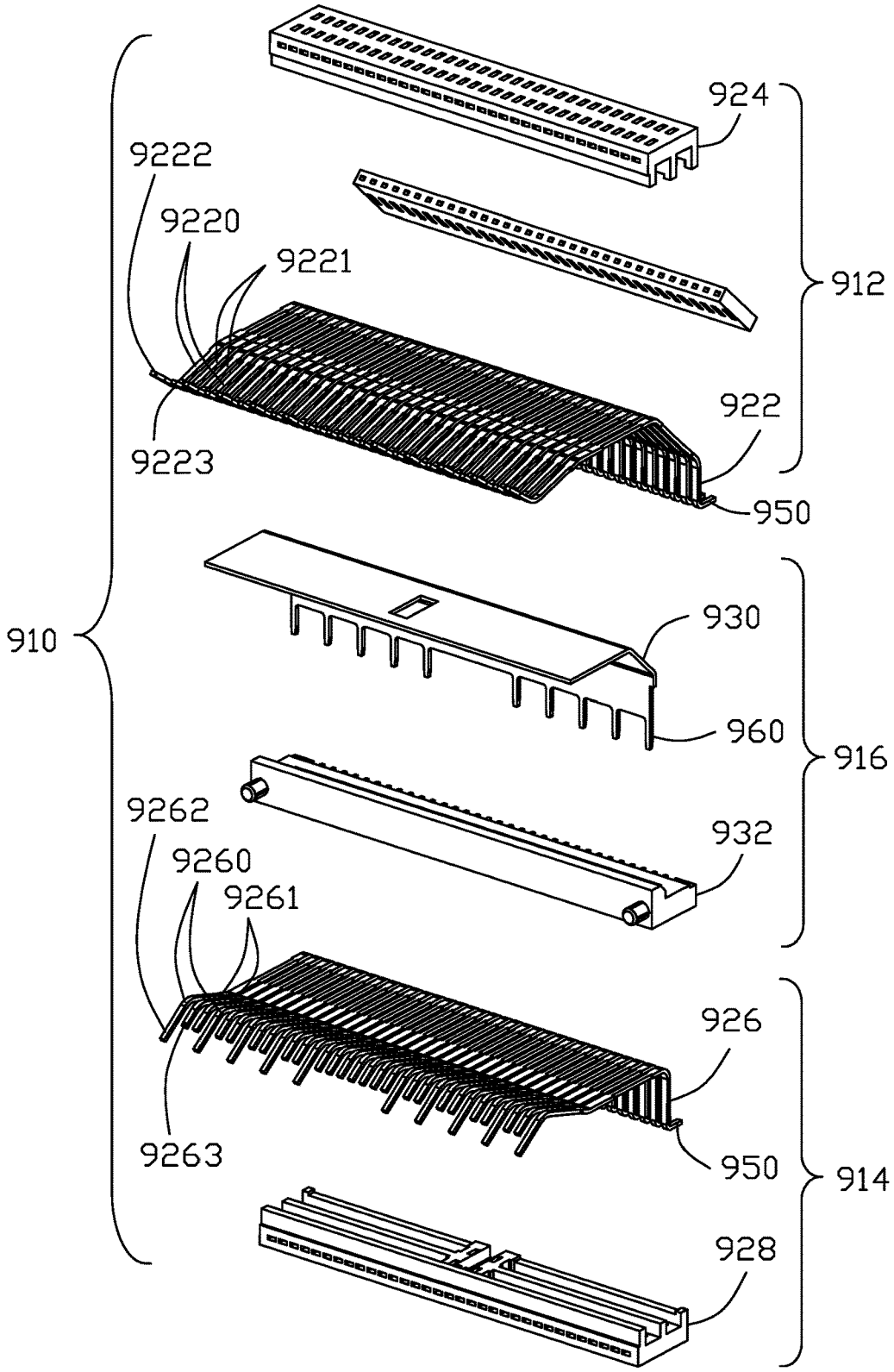
FIG. 5(A) is a front downward further exploded perspective view of the terminal assembly of FIG. 4(A)
Figure 5B:
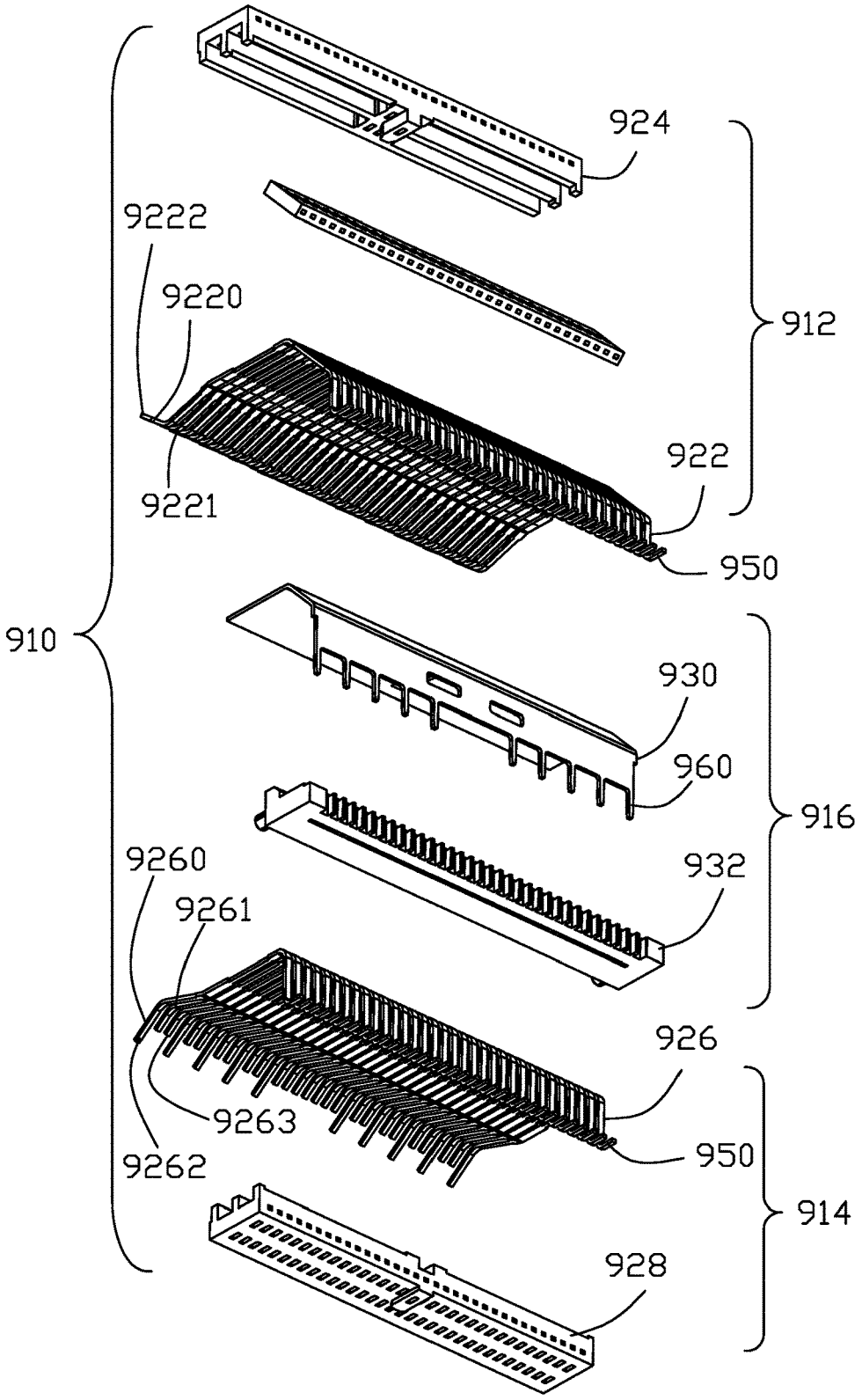
FIG. 5(B) is a rear upward further exploded perspective view of the terminal assembly of FIG. 5(A)
Figure 6A:
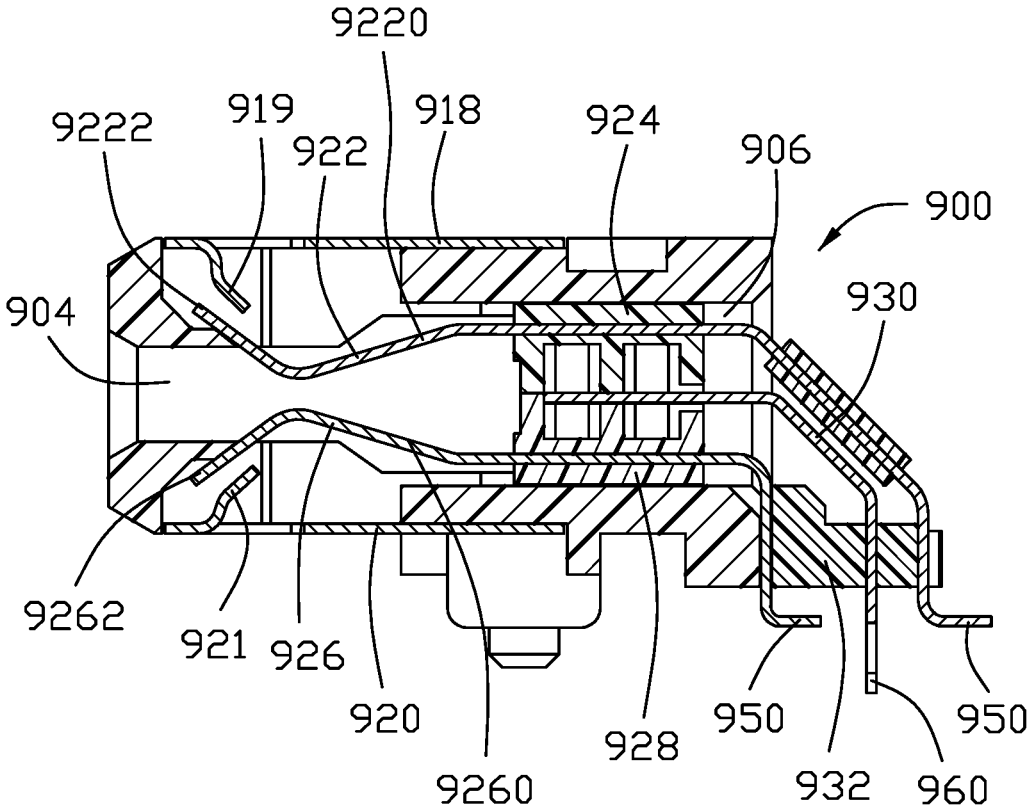
FIG. 6(A) is a cross-sectional view of the receptacle connector of FIG. 1(A) without the plug inserted therein.
Figure 6B:
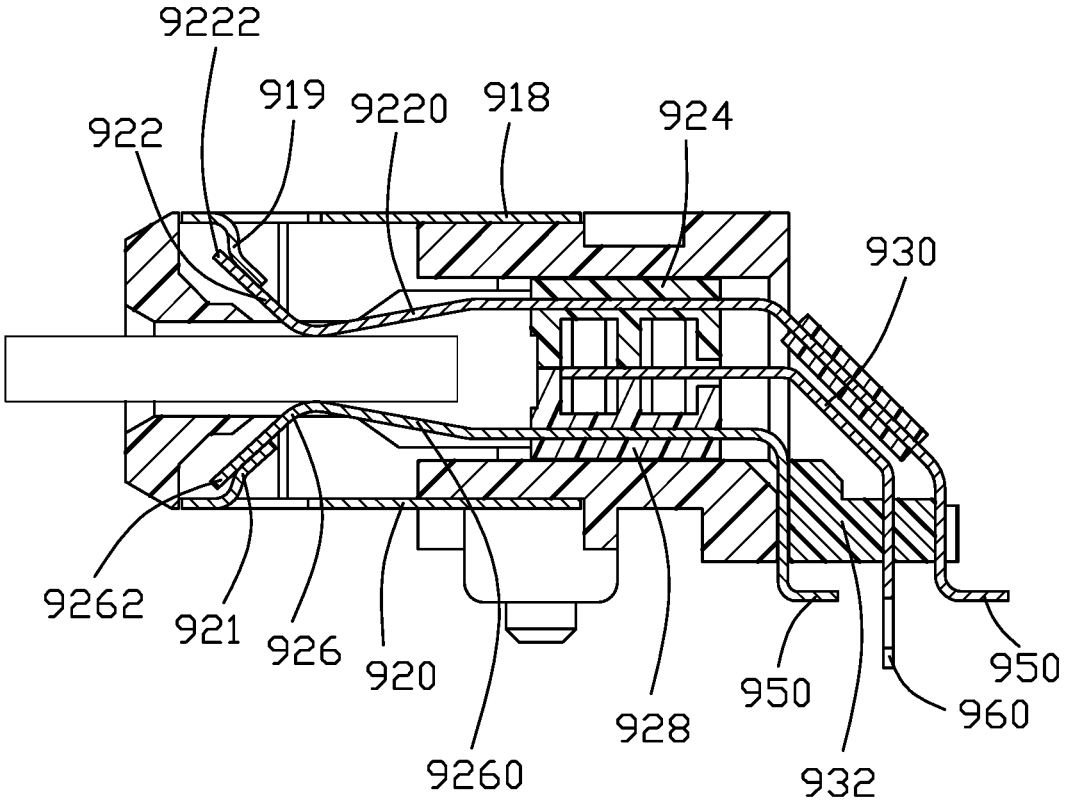
FIG. 6(B) is another cross-sectional view of the receptacle connector of FIG. 1(A) with the plug inserted therein.

FIGS. 1(A)-6 show a first embodiment wherein the receptacle/electrical connector 900 includes an insulative housing 902 with a front cavity 904 for receiving a mating tongue of a complementary plug connector, and a rear cavity 906 opposite to said front cavity 904 in a front-to-back direction to receive a terminal assembly 910 therein. The terminal assembly 910 includes an upper terminal module 912 and a lower terminal module 914 commonly sandwiching a shielding module 916 therebetween in a vertical direction perpendicular to said front-to-back direction. An upper metallic ground plate 918 with the grounding fingers 919 thereon is located upon an upper surface of the insulative housing 902 and extending into the front cavity 904 of the insulative housing 902, and a lower metallic ground plate 920 with the grounding fingers 921 is located upon a bottom surface of the housing 902 and extending into the front cavity 904 of the insulative housing 902. The insulative housing 902 forms a plurality of slots 903 extending through an upper and a bottom wall of the insulative housing 902 for the grounding fingers 919 and 921 extending into the front cavity 904 of the insulative housing 902.

The upper terminal module 912 includes a plurality of upper terminals 922 integrally formed with an upper insulator 924 via an insert molding process. The upper terminals 922 comprising pairs of upper ground terminals 9220 and pairs of upper differential signal terminals 9221 with each pair of upper differential signal terminals 9221 disposed between a pair of the upper ground terminals 9220. Each of the upper ground terminals 9220 comprises a front free end 9222 longer than each of a front free end 9223 of the upper differential signal terminals 9221. The upper grounding terminals 9220 are adapted to contact/deflect to mechanically and electrically connect to the corresponding grounding fingers 919, respectively, when the plug connector is inserted into the front cavity 904. The upper grounding terminals 9220 are not contact/deflect to mechanically and electrically connect to the corresponding grounding fingers 919 with the plug connector is not inserted into the front cavity 904. Similarly, the lower terminal module 914 includes a plurality of lower terminals 926 integrally formed with a lower insulator 928 via another insert molding process. The lower terminals 926 comprising pairs of lower ground terminals 9260 and pairs of lower differential signal terminals 9261 with each pair of lower differential signal terminals 9261 disposed between a pair of the lower ground terminals 9260. Each of the lower ground terminals 9260 comprises a front free end 9262 longer than each of a front free end 9263 of the lower differential signal terminals 9261. The lower grounding terminals 9260 are adapted to contact/deflect to mechanically and electrically connect to the corresponding grounding finger 921, respectively, when the plug connector is inserted into the front cavity 904. The lower grounding terminals 9260 are not adapted to contact/deflect to mechanically and electrically connect to the corresponding grounding finger 921 with the plug connector is inserted into the front cavity 904. The shielding module 916 includes a shielding plate 930 associated with a spacer 932 via another insert molding process for separating the upper terminal module 912 and the lower terminal module 914 from each other structurally. Each of the upper and the lower terminals 912, 914 comprises a tail portion 950 extending downwardly and beyond a bottom surface of the insulative housing 902 for being surface mounted on a printed circuit board. The shielding plate 930 comprises a plurality shielding tail 960 extending downwardly and beyond a top surface of the tail portions 950 for being mounted on the printed circuit board by through hole manner.

Figure 7:
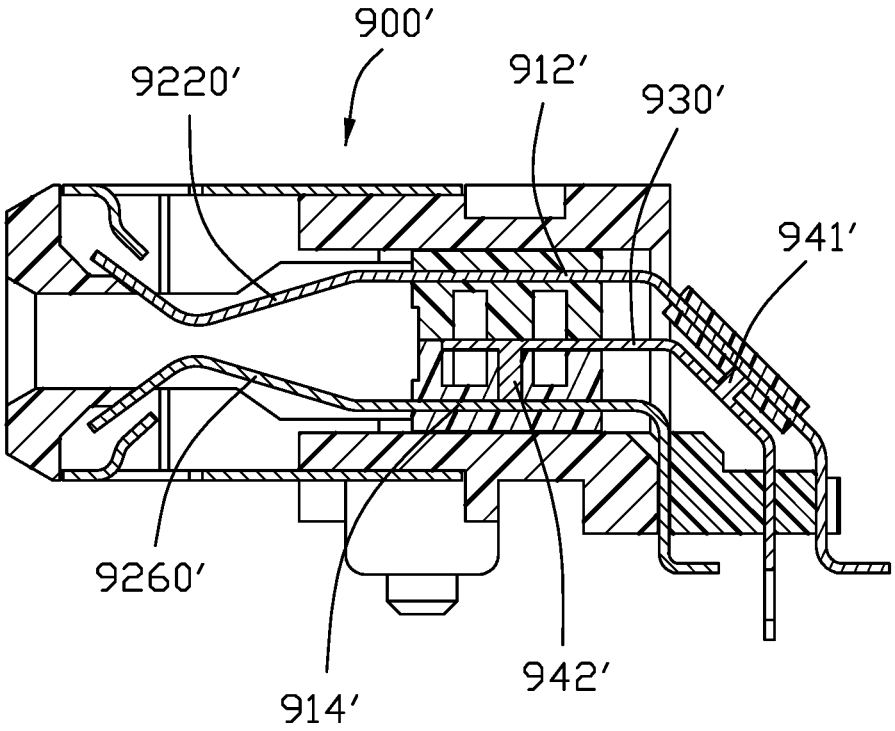
FIG. 7 is a cross-sectional view of the receptacle connector of FIG. 1(A) with the shielding plate electrically connected with the grounding terminals of the upper terminal module and the lower terminal module.
Figure 8:
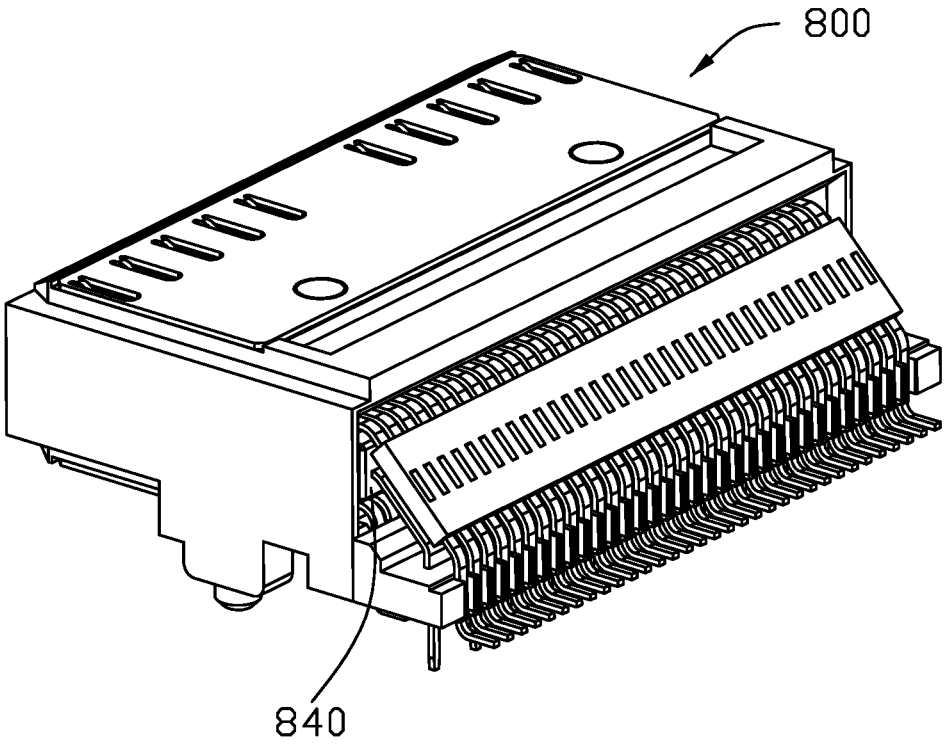
FIG. 8 is a rear upward perspective view of the receptacle connector for use with a plug cable connector according to a second embodiment of the invention.
Figure 9A:
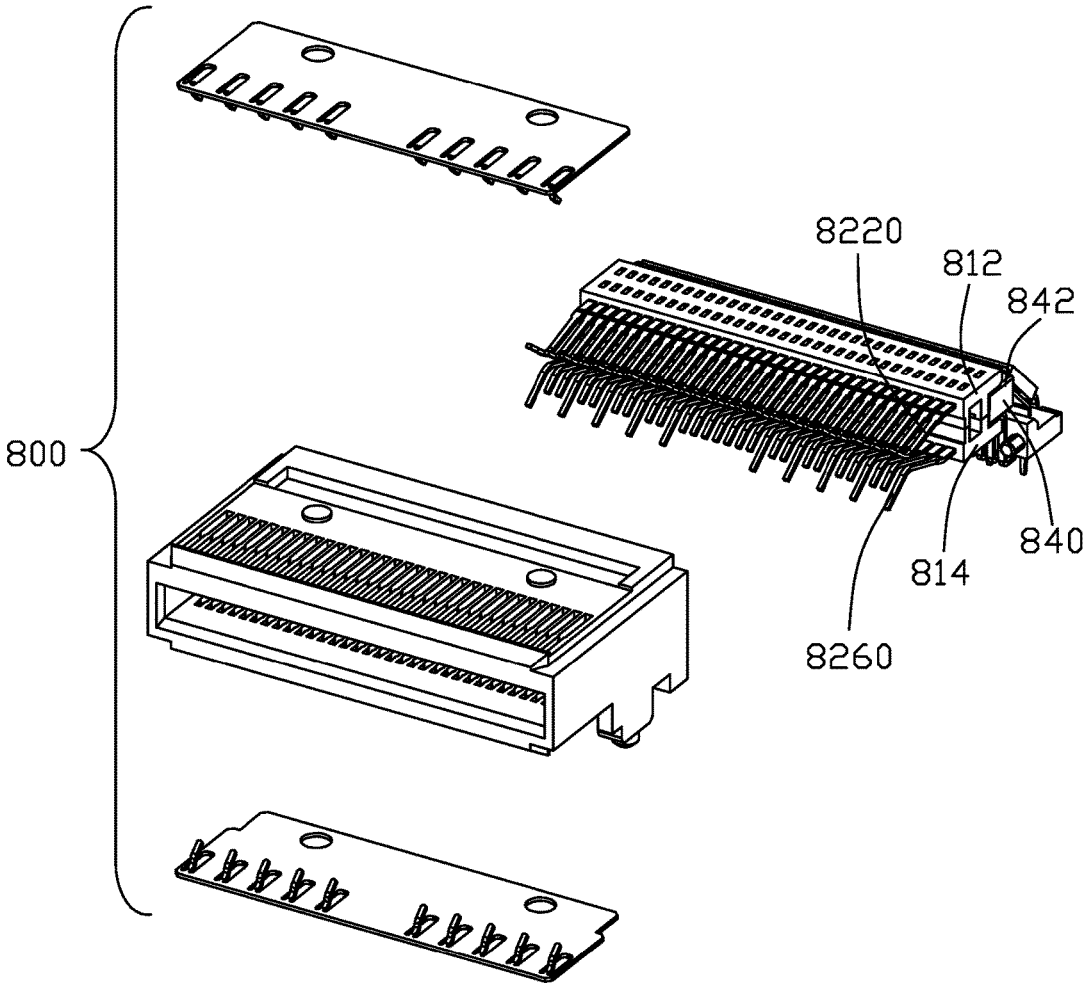
FIG. 9(A) is a front downward exploded perspective view of the receptacle connector of FIG. 8.
Figure 9B:
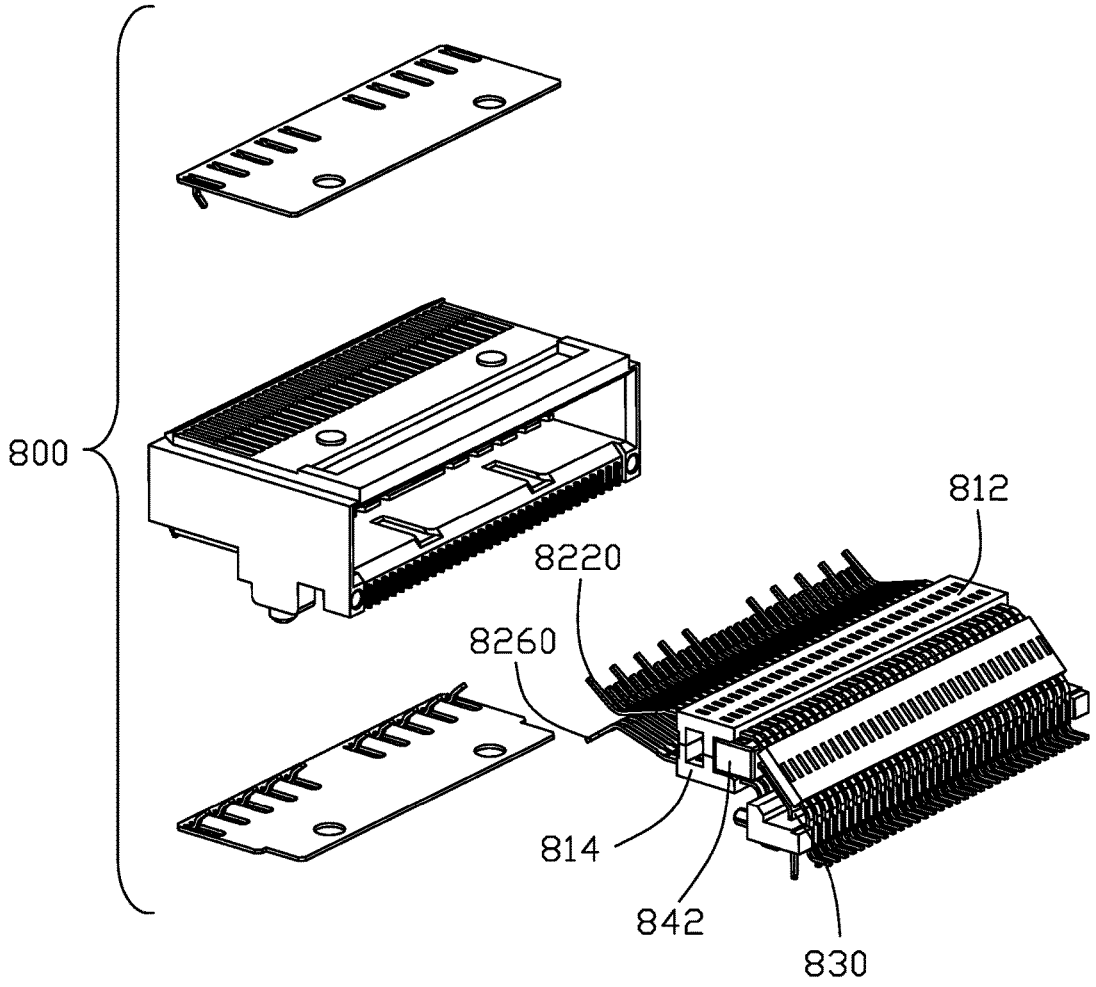
FIG. 9(B) is a rear upward exploded perspective view of the receptacle connector of FIG. 8.

FIG. 7 show a cross-sectional view of the receptacle connector 900' of FIG. 1(A) with the shielding plate 930' mechanically and electrically connected with the grounding terminals 9220' of the upper terminal module 912' by upper connection portion 941' and connected with the grounding terminals 9260' of the lower terminal module 914' by lower connection portion 942'.

Figure 10:
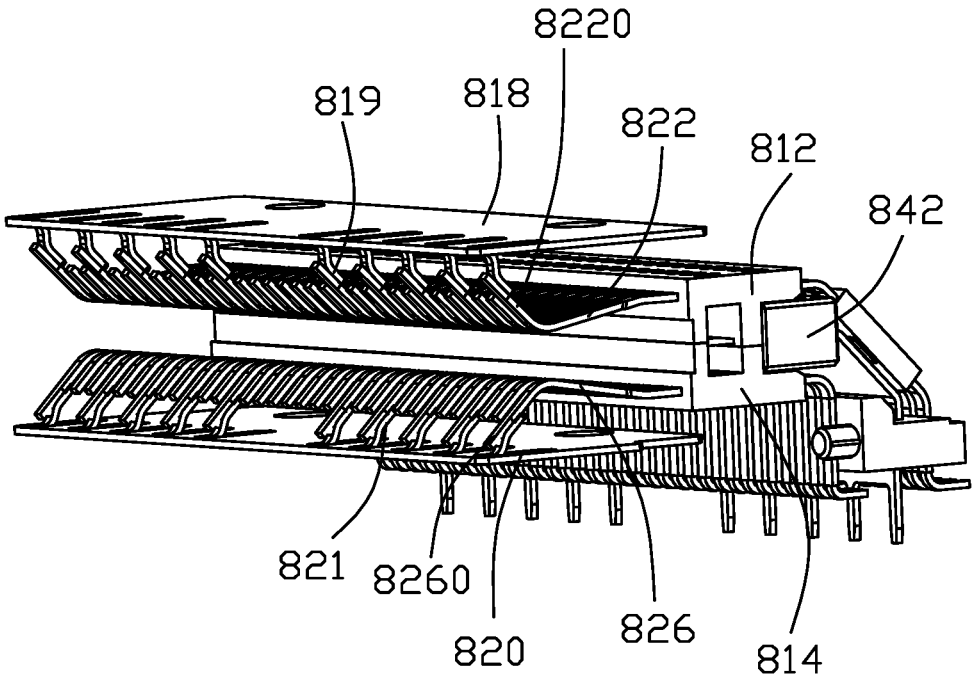
FIG. 10 is a front perspective view of the grounding fingers of the upper metallic ground plate and the lower metallic ground plate connected with the grounding terminals of the upper terminal module and the lower terminal module of the receptacle connector of FIG. 8 with the housing and the plug connector removed for clear illustration.
Figure 11A:
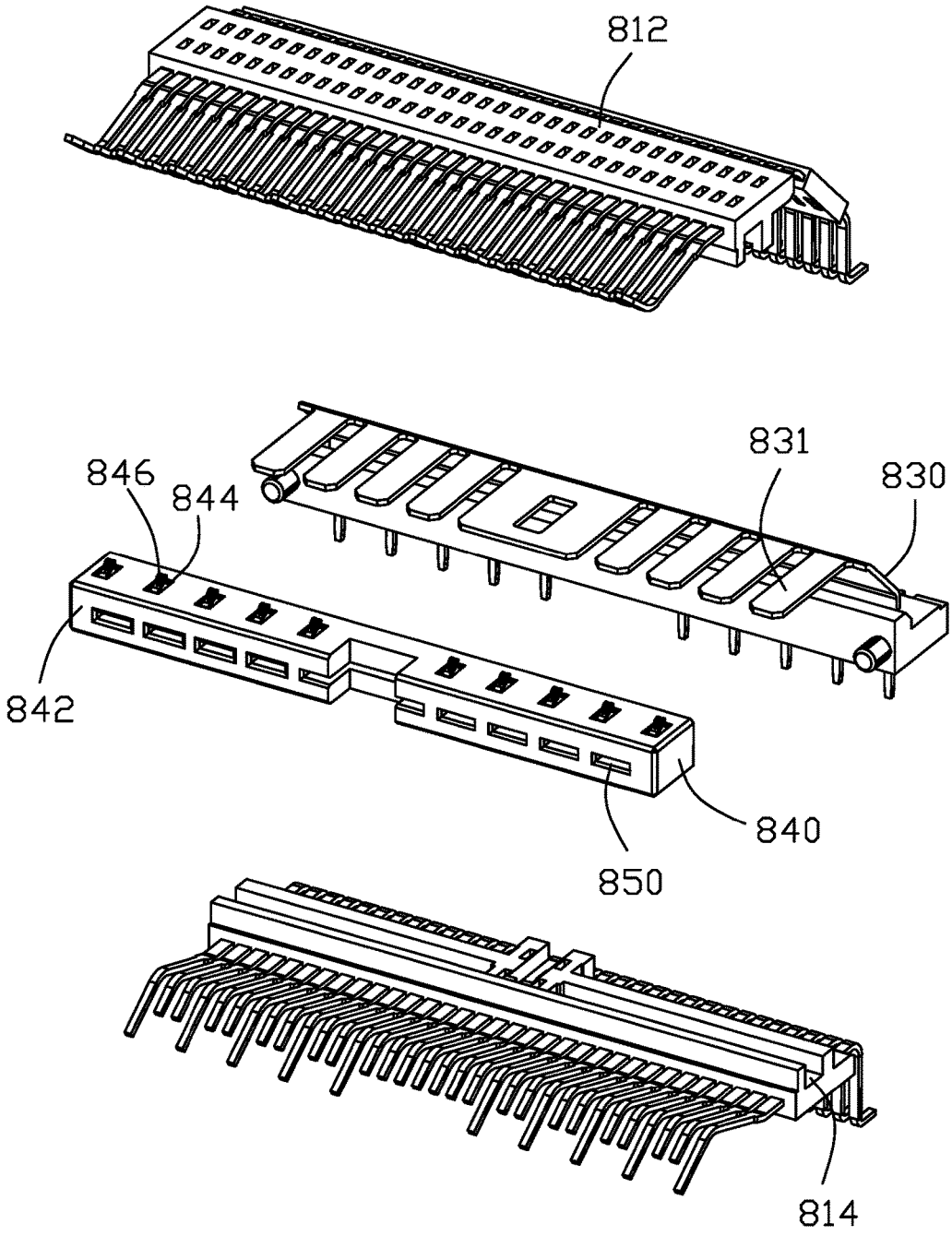
FIG. 11(A) is a front downward exploded perspective view of the terminal assembly of the receptacle connector of FIG. 8.
Figure 11B:
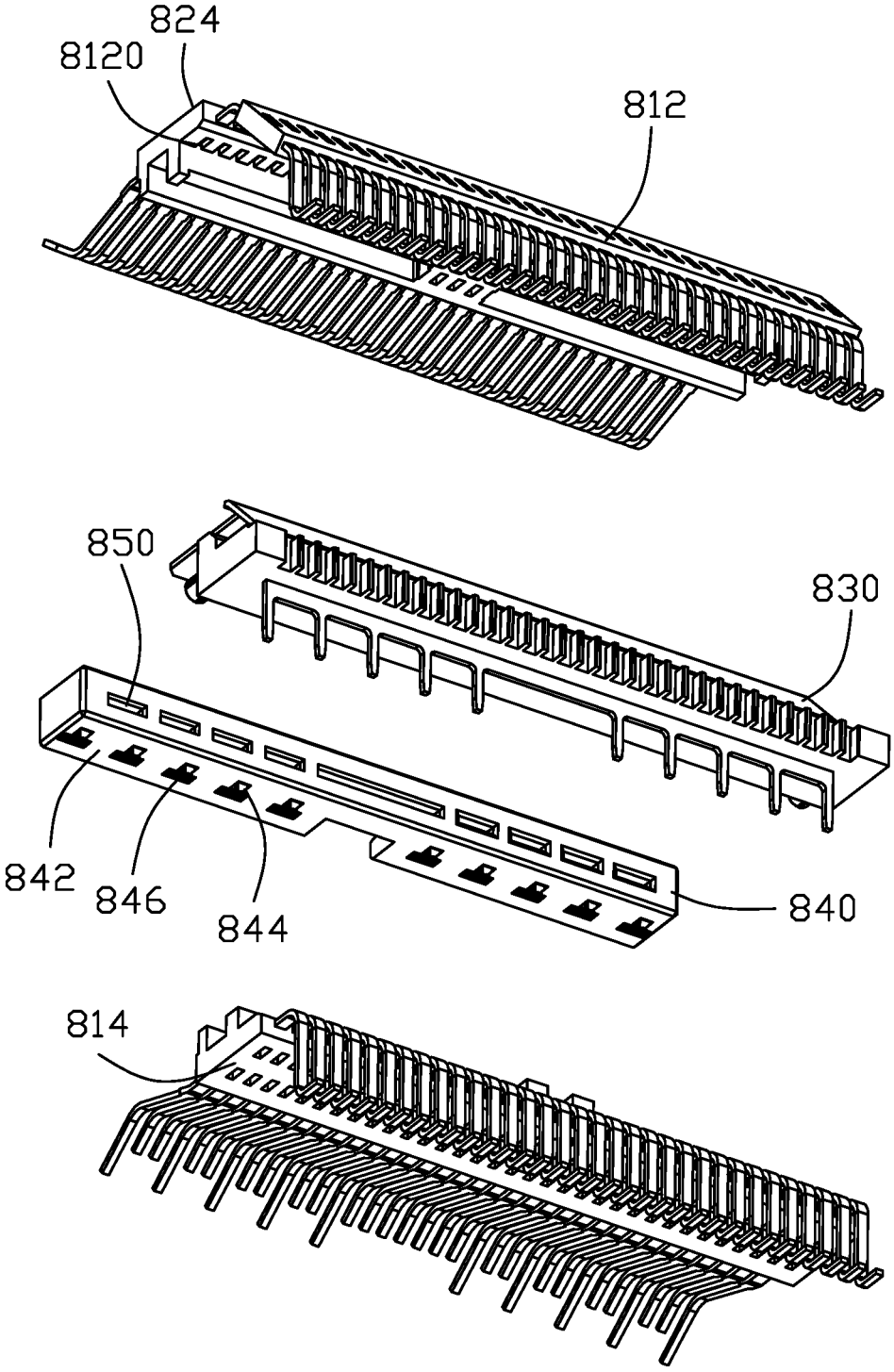
FIG. 11(B) is a rear upward exploded perspective view of the terminal assembly of FIG. 11(A)
Figure 12A:
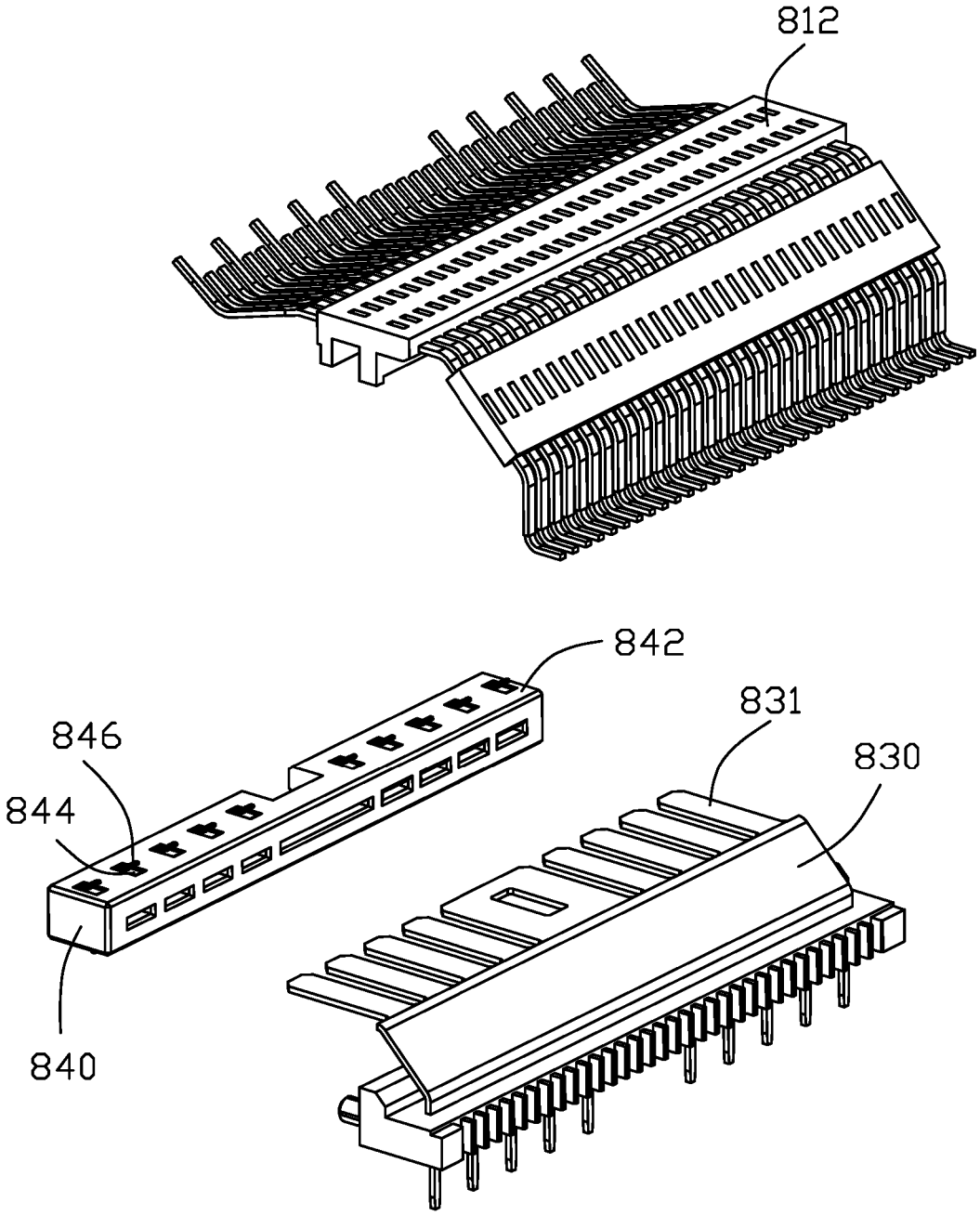
FIG. 12(A) is a rear upward exploded perspective view of the terminal assembly of FIG. 11(A) without the lower terminal module.
Figure 12B:
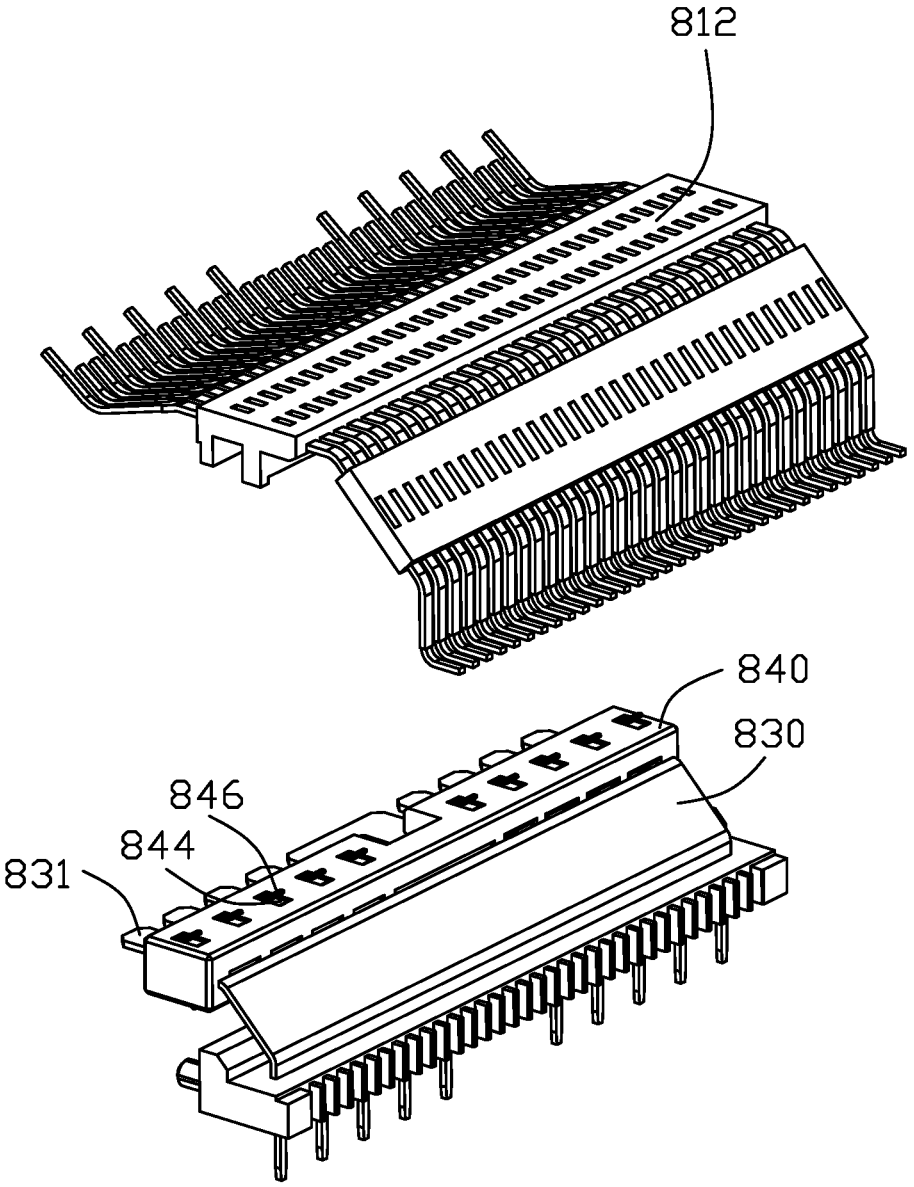
FIG. 12(B) is a rear upward perspective view of the terminal assembly of FIG. 12(A)
Figure 13A:
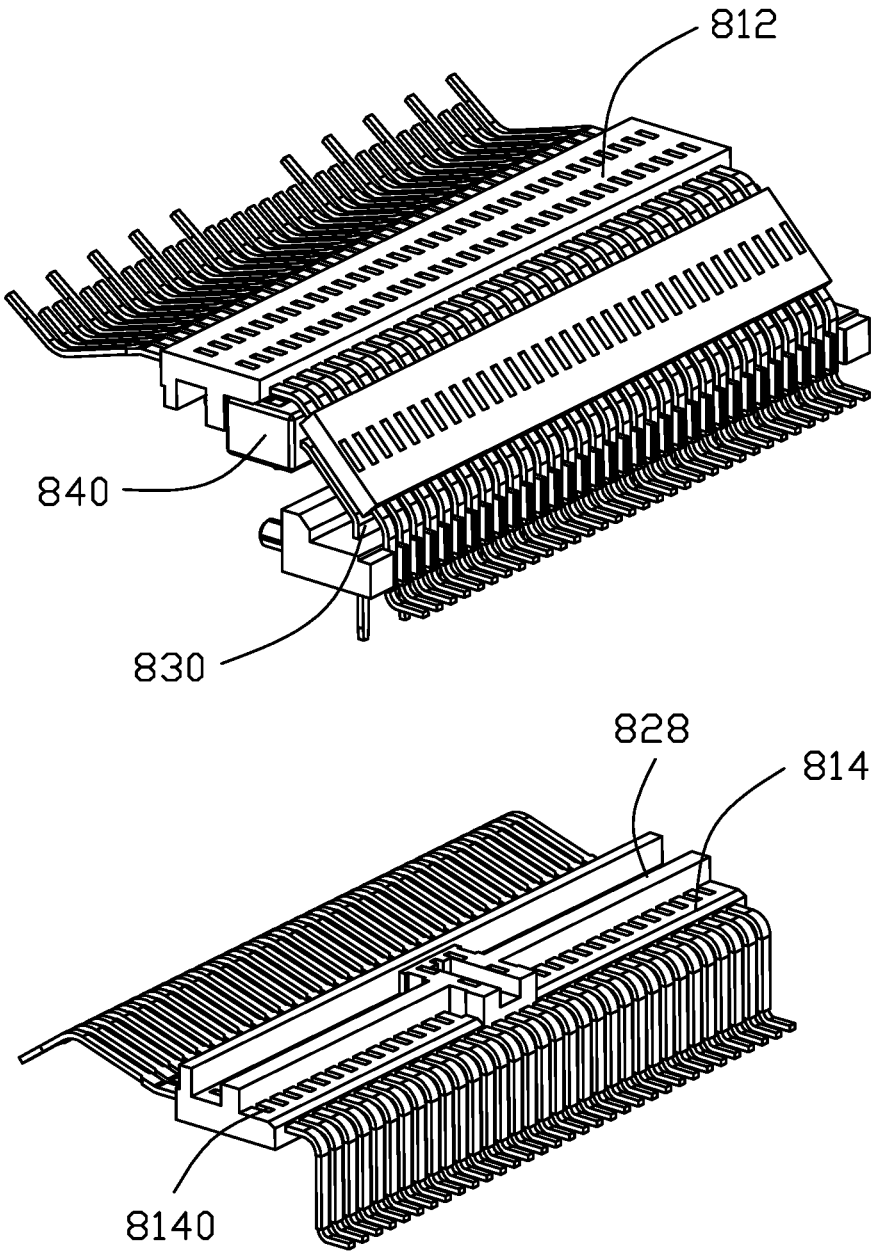
FIG. 13(A) is a rear upward exploded perspective view of the terminal assembly of FIG. 9(A)
Figure 13B:
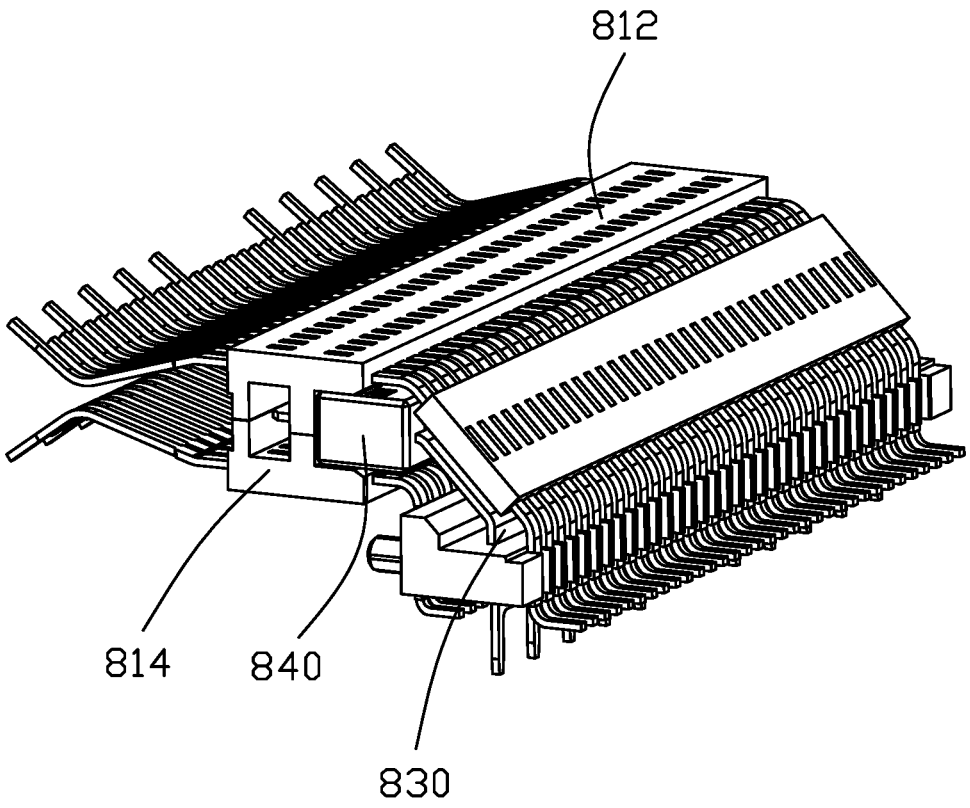
FIG. 13(B) is a rear upward perspective view of the terminal assembly of FIG. 13(A)
Figure 14:
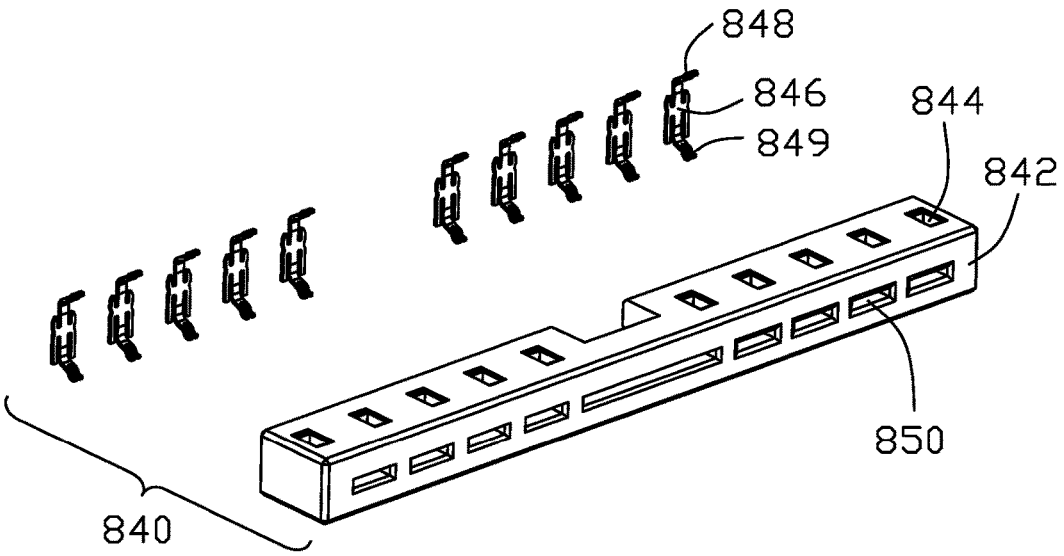
FIG. 14 is a perspective view of the common ground contact sub-assembly of the terminal assembly of FIG. 11(A)
Figure 15:
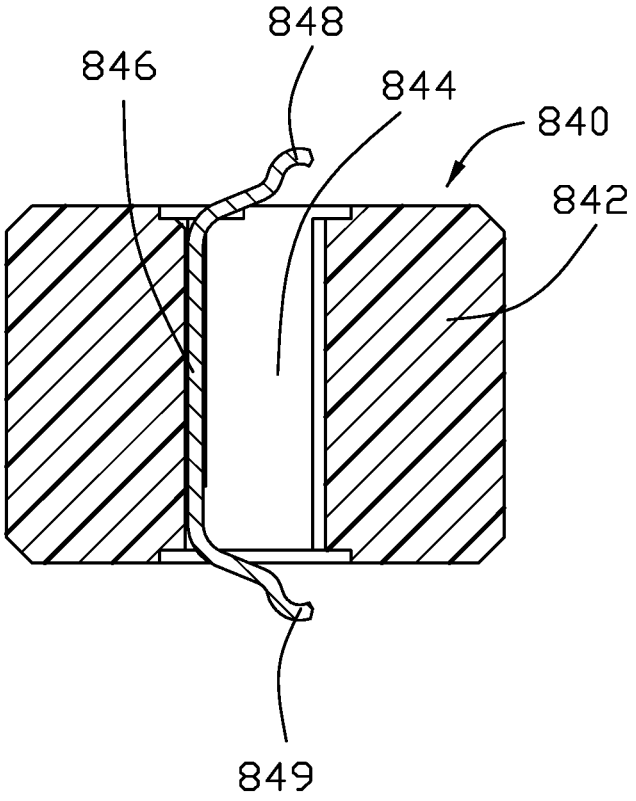
FIG. 15 is a cross-sectional view of the contact sub-assembly of the terminal assembly of FIG. 11(A)
Figure 16:
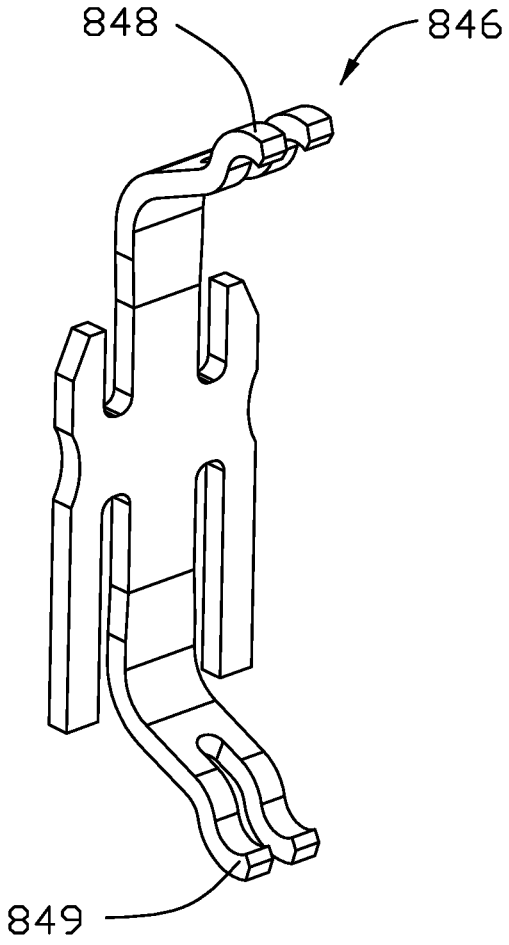
FIG. 16 is a perspective of the contact of the contact sub-assembly of the terminal assembly of FIG. 11(A)
Figure 17:
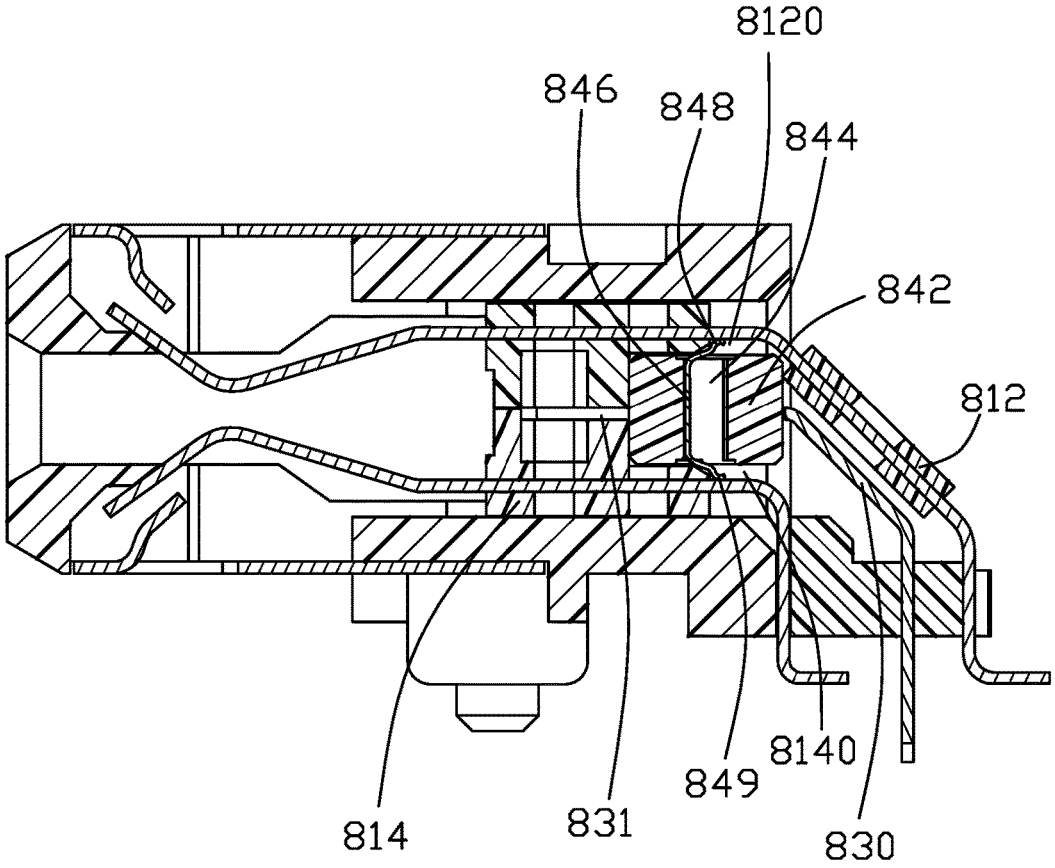
FIG. 17 is across-sectional view of the receptacle connector of FIG. 8.
Figure 18:
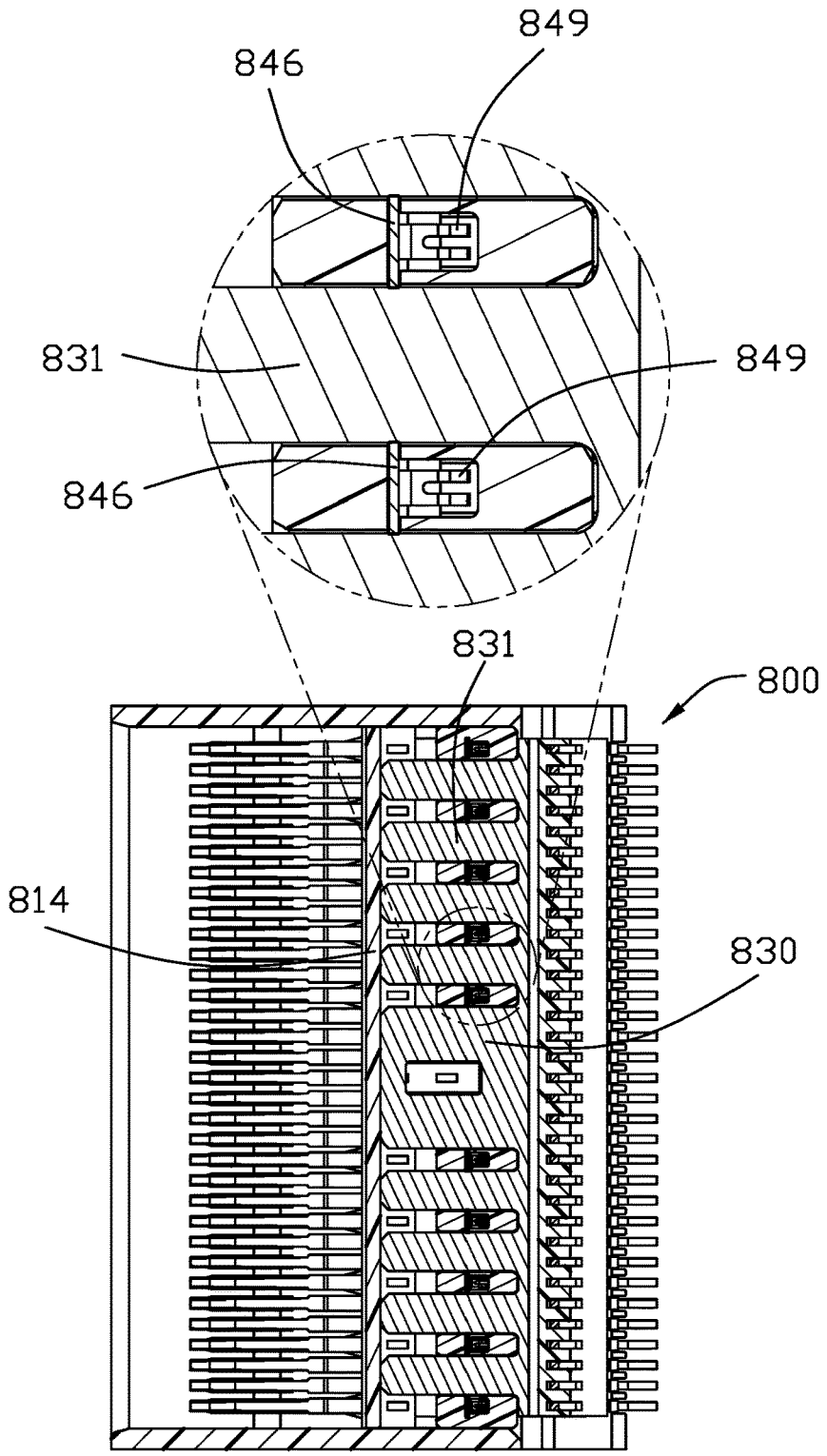
FIG. 18 is another across-sectional view of the receptacle connector of FIG. 8.
Figure 19:
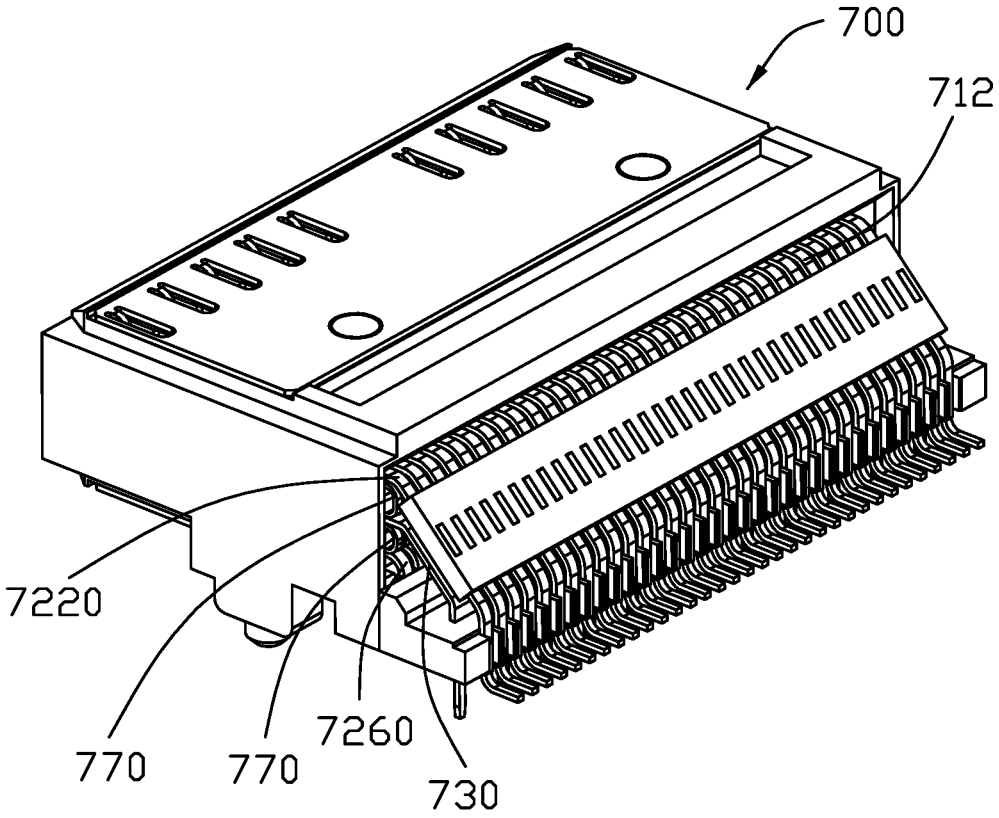
FIG. 19 is a front downward perspective view of the receptacle connector for mating with a plug cable connector according to a third embodiment of the invention.
Figure 20A:
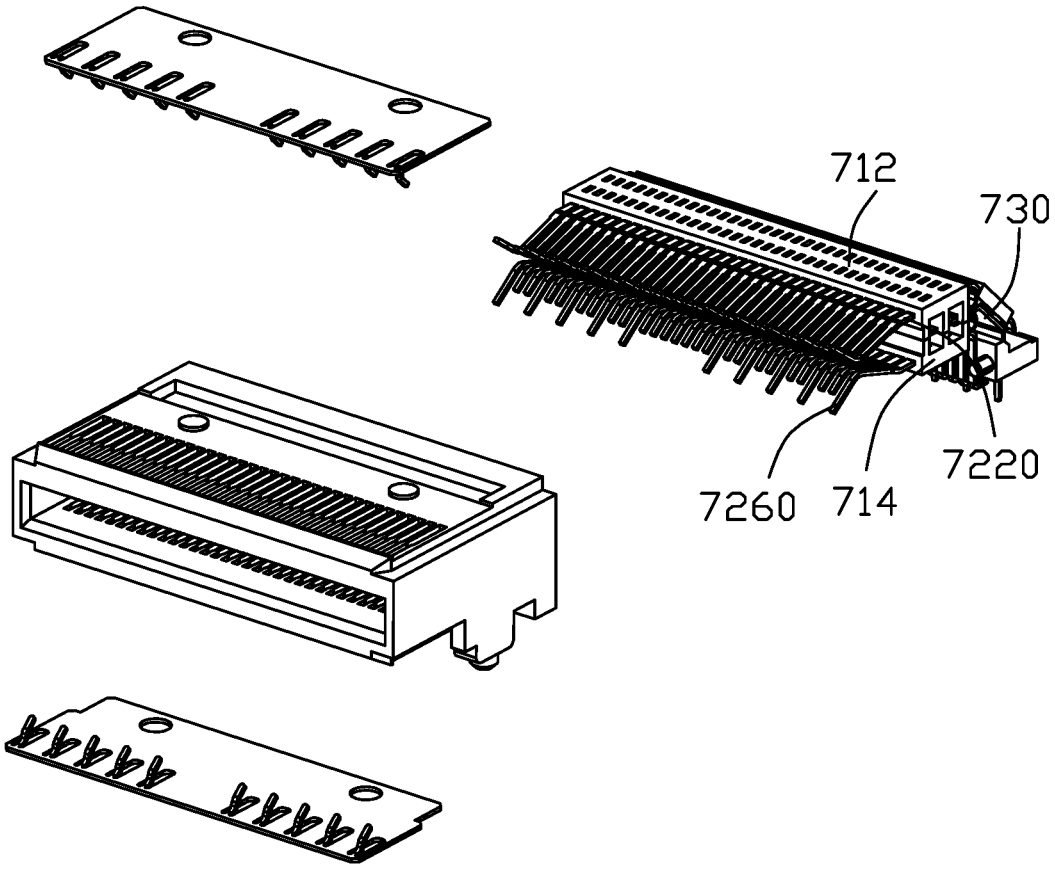
FIG. 20(A) is a front downward exploded perspective view of the receptacle connector of FIG. 19.
Figure 20B:
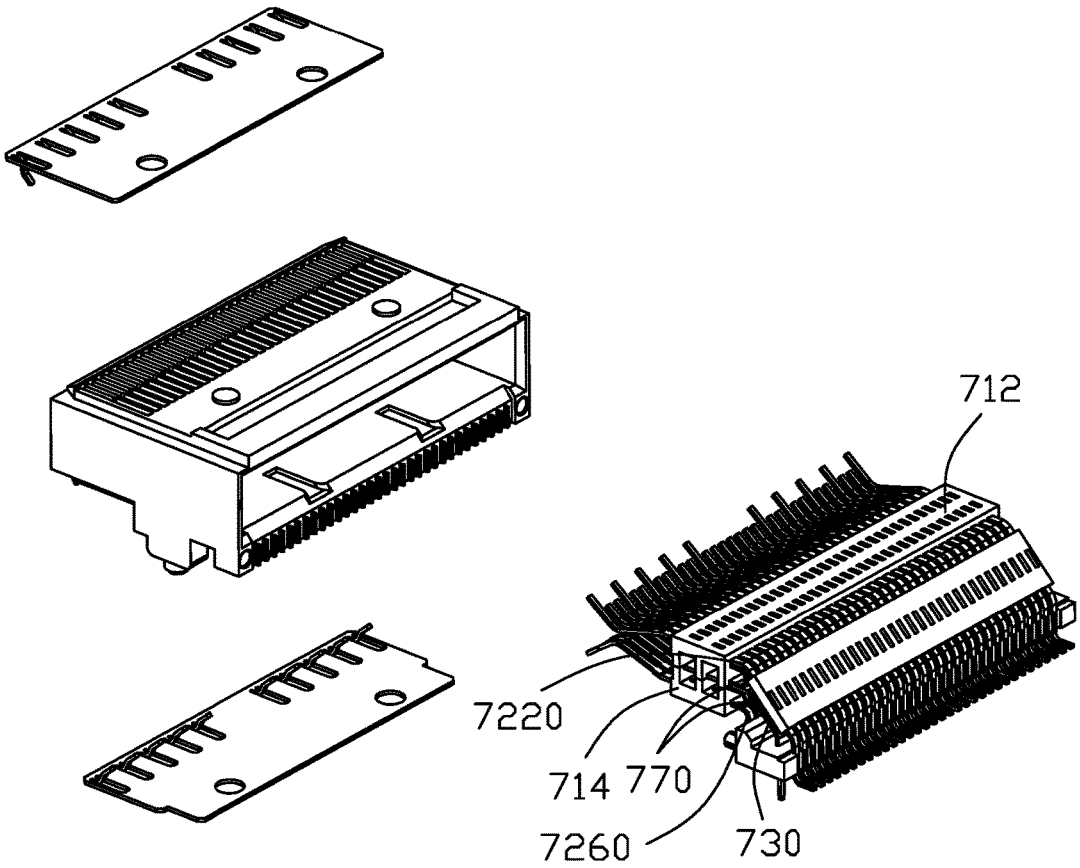
FIG. 20(B) is a rear upward exploded perspective view of the receptacle connector of FIG. 20(A)
Figure 21:
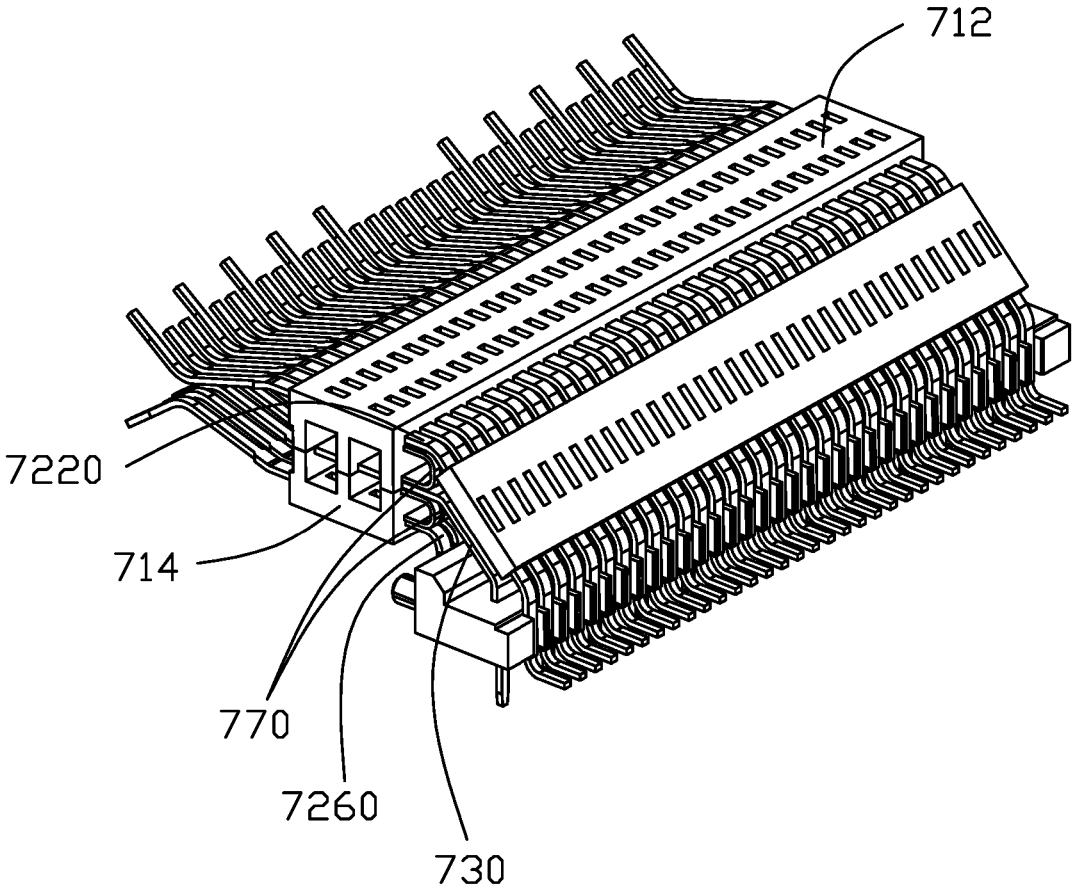
FIG. 21 is a terminal assembly of the receptacle connector of FIG. 20(A)
Figure 22A:
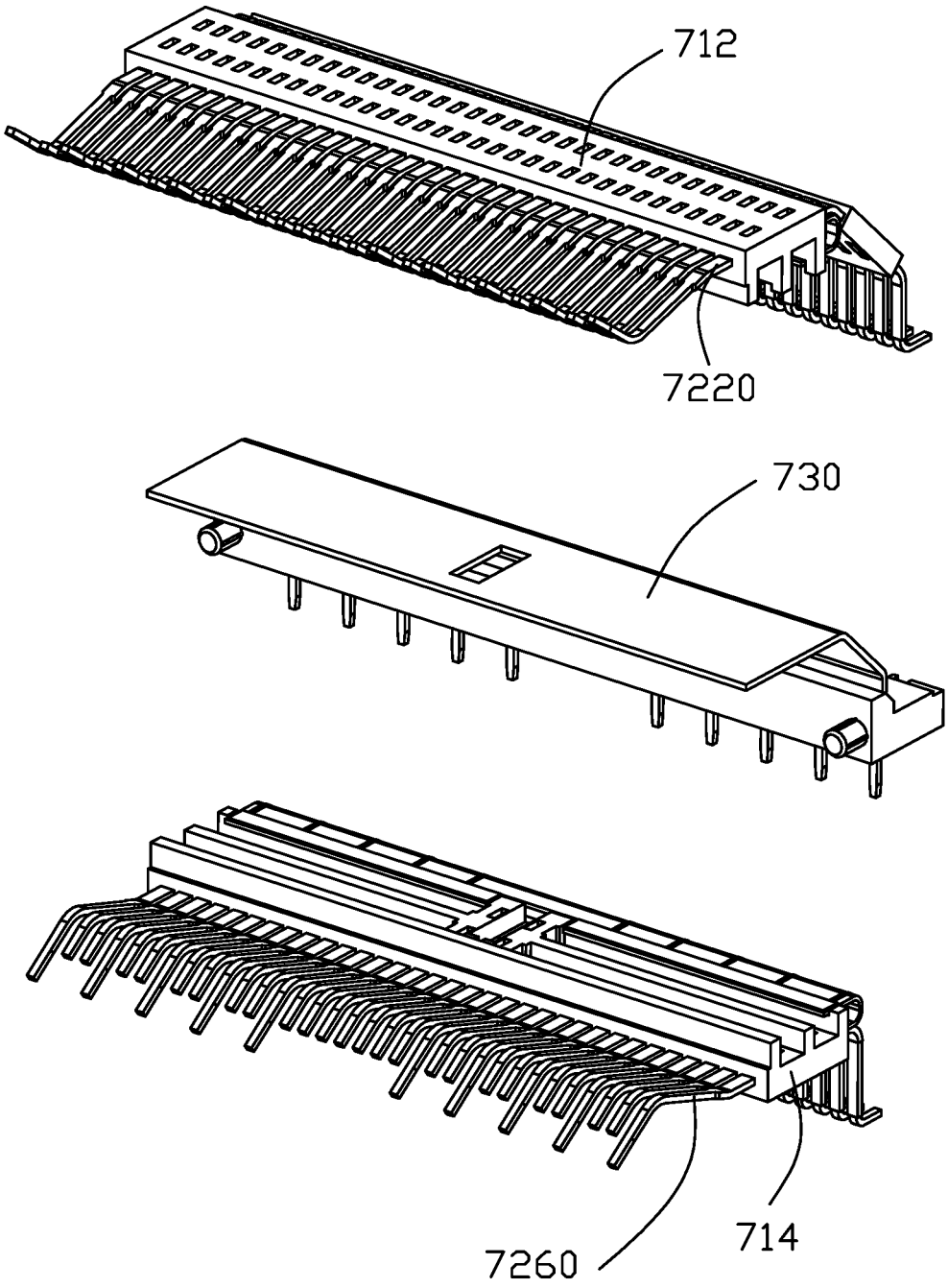
FIG. 22(A) is a front downward exploded perspective view of the terminal assembly of the receptacle connector of FIG. 19.
Figure 22B:
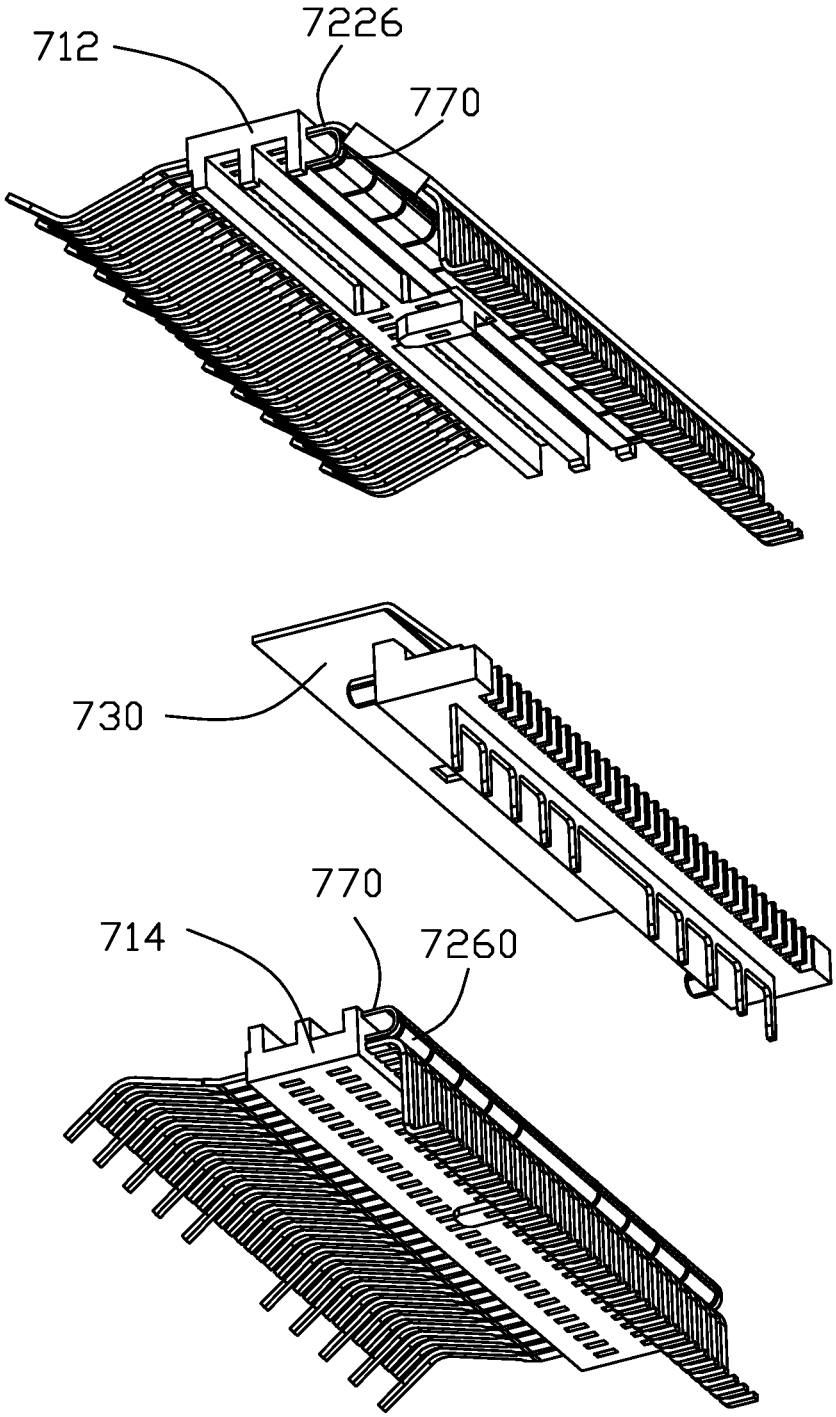
FIG. 22(B) is a rear upward exploded perspective view of the terminal assembly of FIG. 19.
Figure 23A:
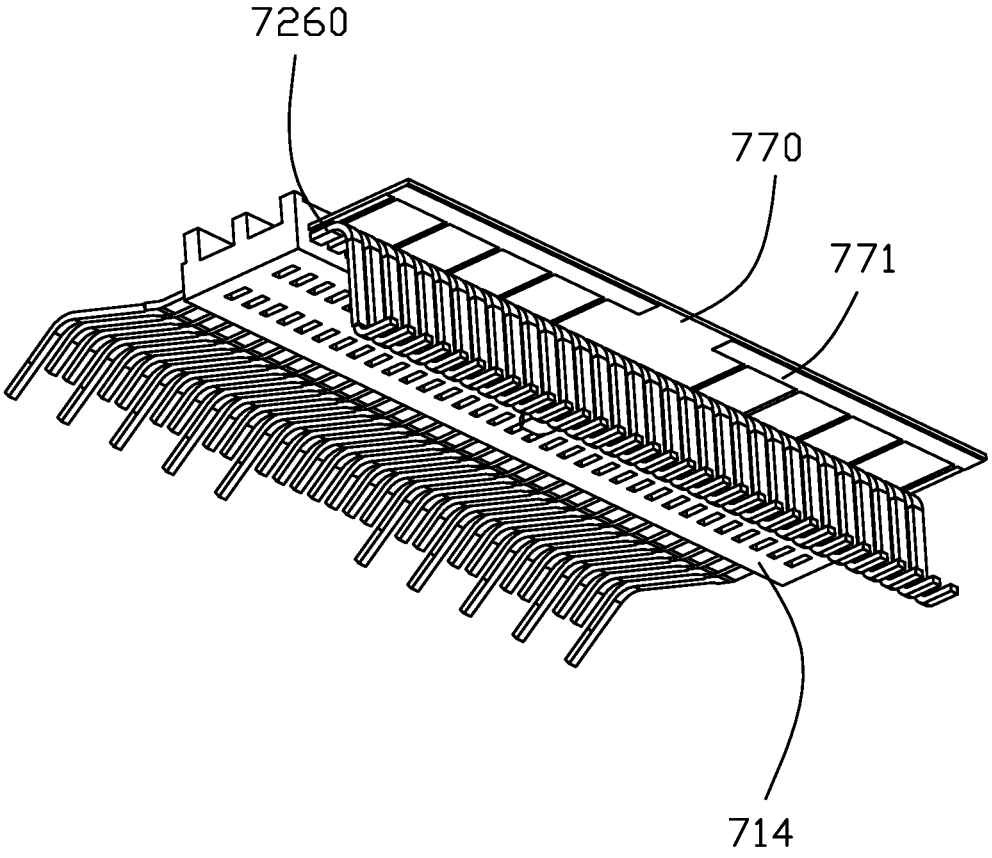
FIG. 23(A) is a rear upward perspective view of the lower terminal module of the terminal assembly of FIG. 22(A) wherein the FPC is not folded backward.
Figure 23B:
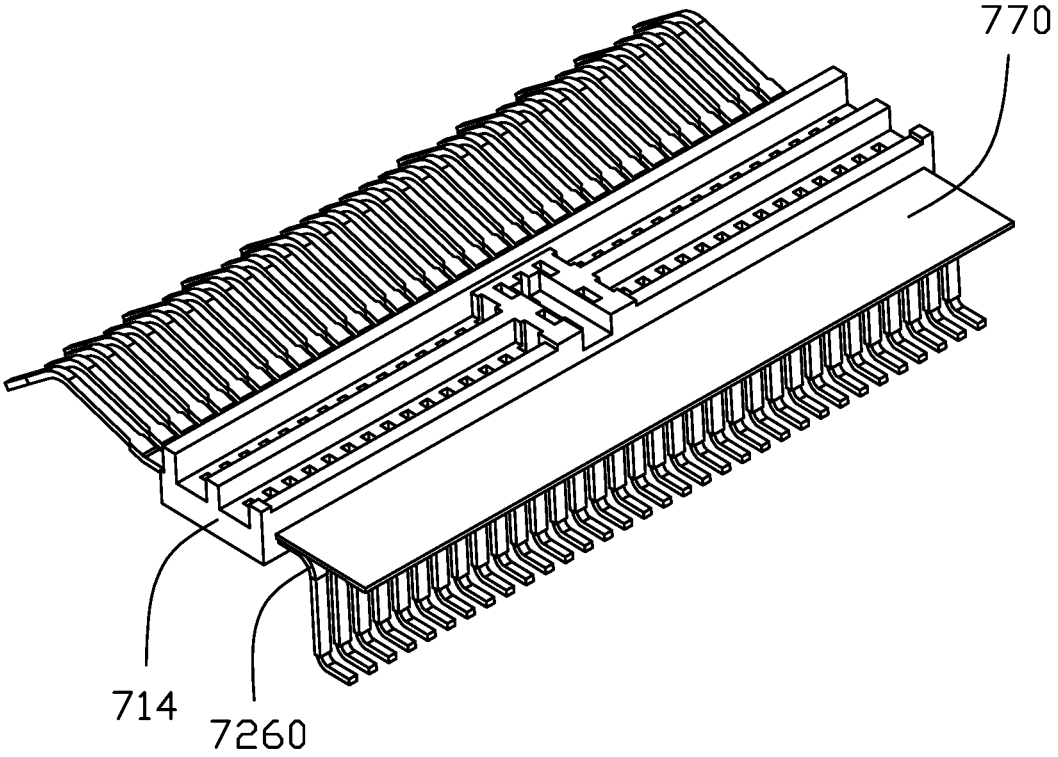
FIG. 23(B) is a rear downward perspective view of the lower terminal module of the terminal assembly of FIG. 23(A)
Figure 24:
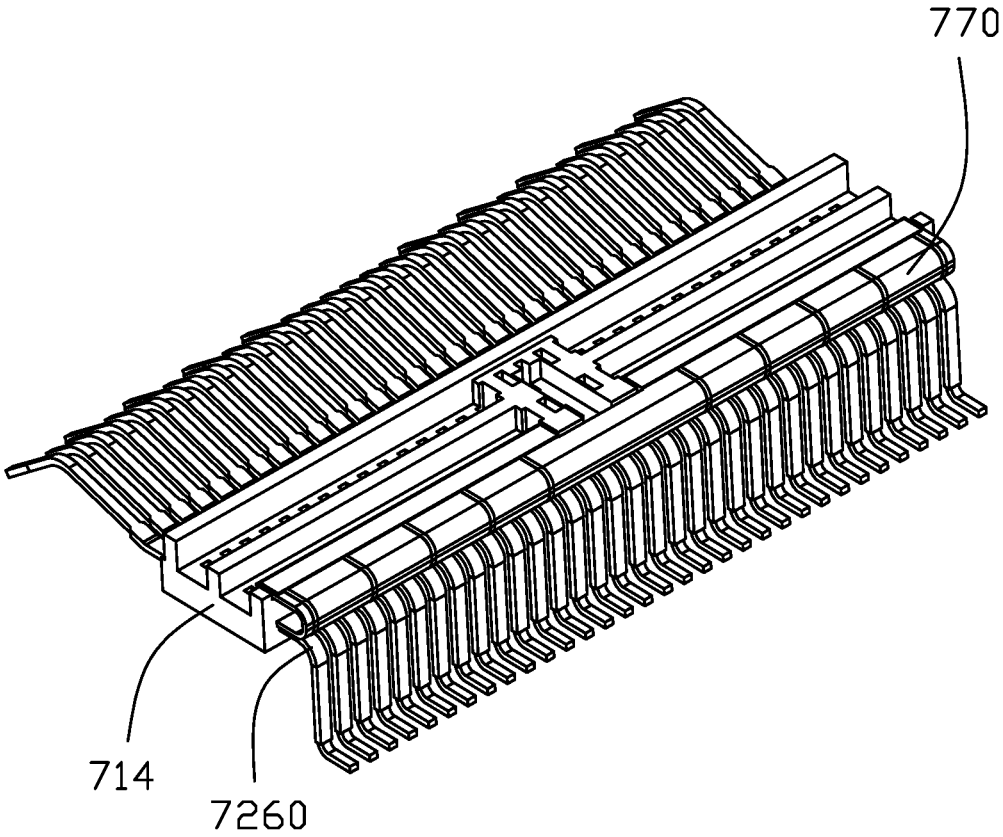
FIG. 24 is a rear upward perspective view of the lower terminal module of FIG. 23(A) with the FPC folded backward.
Figure 25:
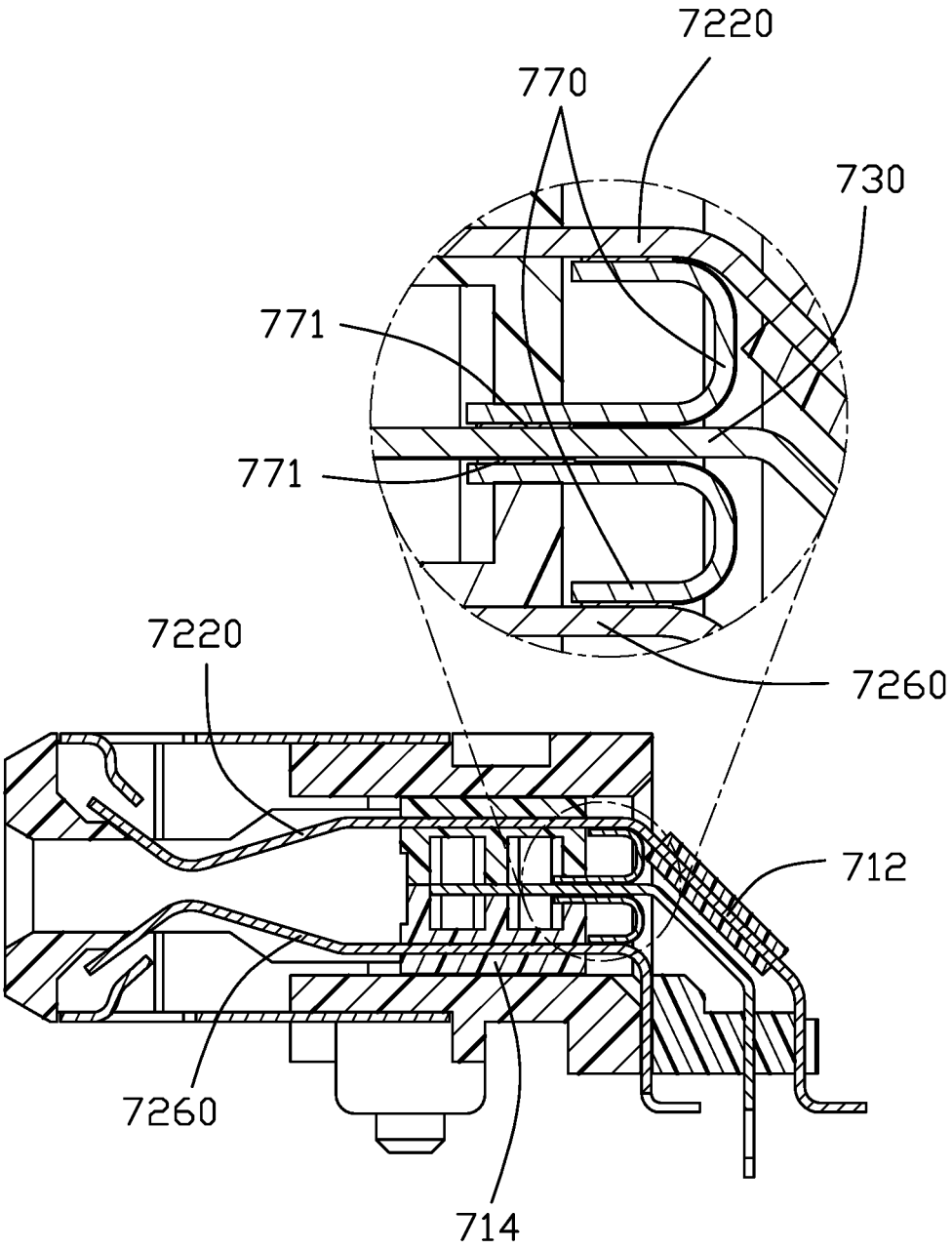
FIG. 25 is a cross-sectional view of the receptacle connector of FIG. 19.
Figure 26A:
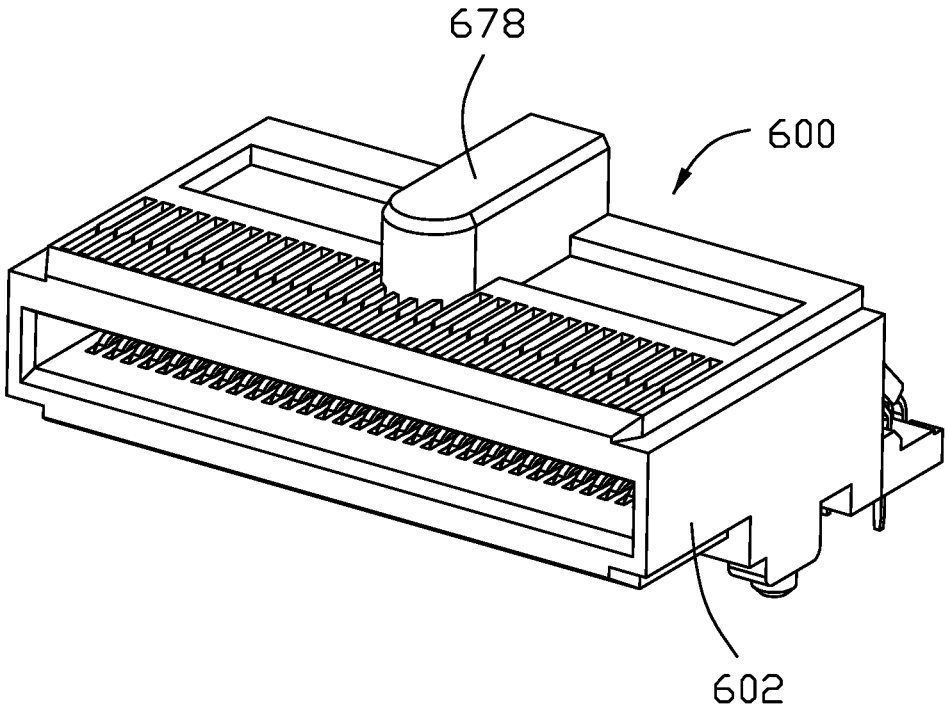
FIG. 26(A) is a front downward perspective view of the electrical receptacle according to a fourth embodiment of the invention.
Figure 26B:
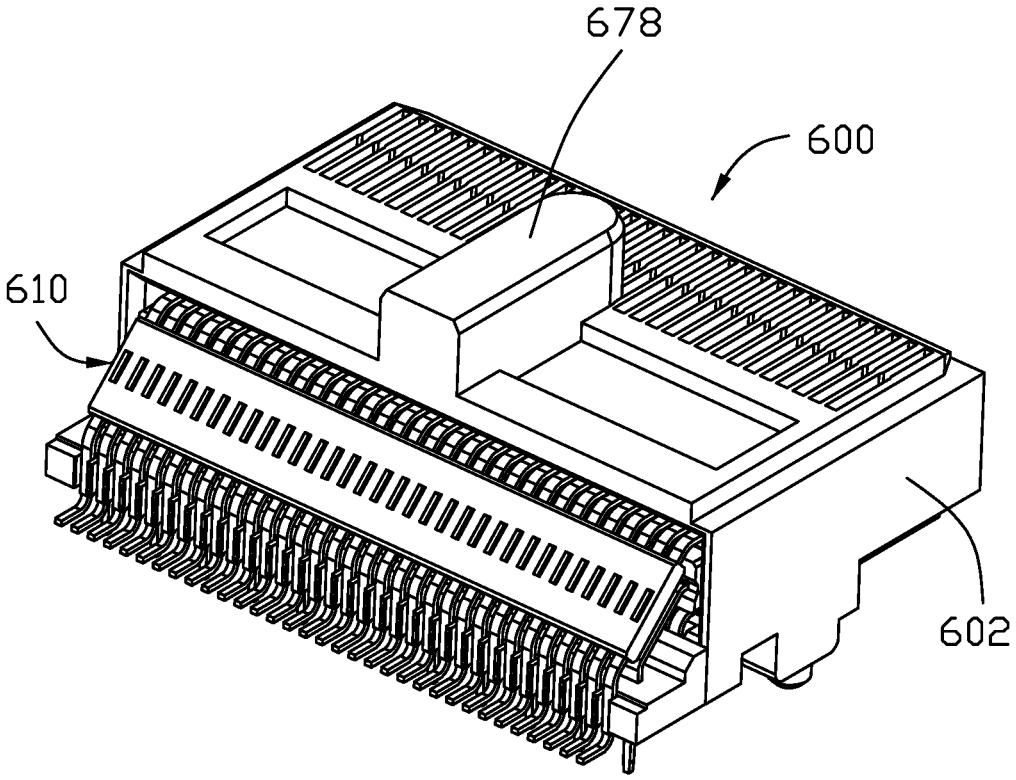
FIG. 26(B) is a rear downward perspective view of the electrical receptacle of FIG. 26(A)
Figure 26C:
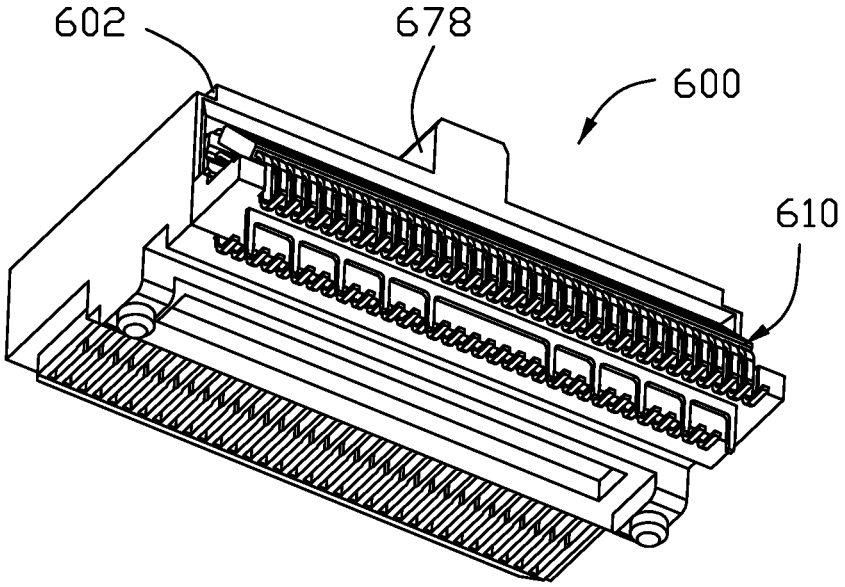
FIG. 26(C) is a rear upward perspective view of the electrical receptacle of FIG. 26(A)
Figure 27:
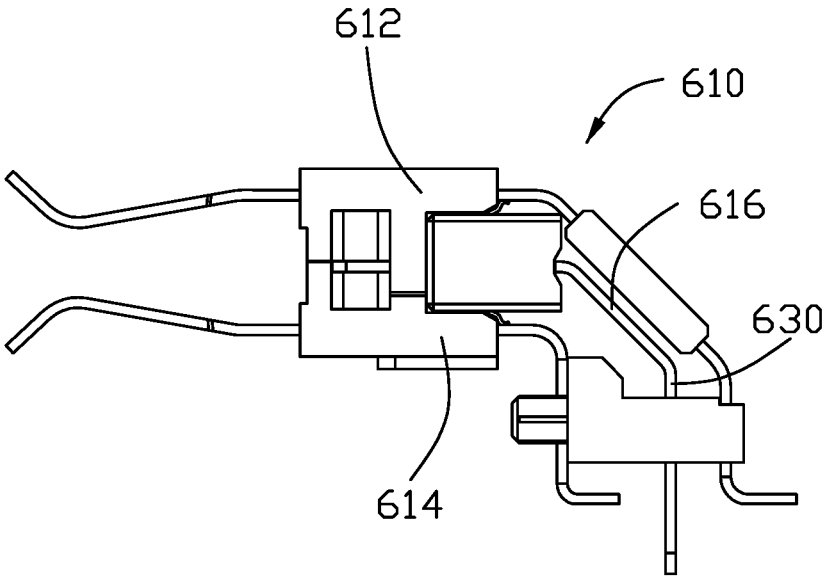
FIG. 27 is a side view of the terminal module of the electrical receptacle of FIG. 26(A)
Figure 28:
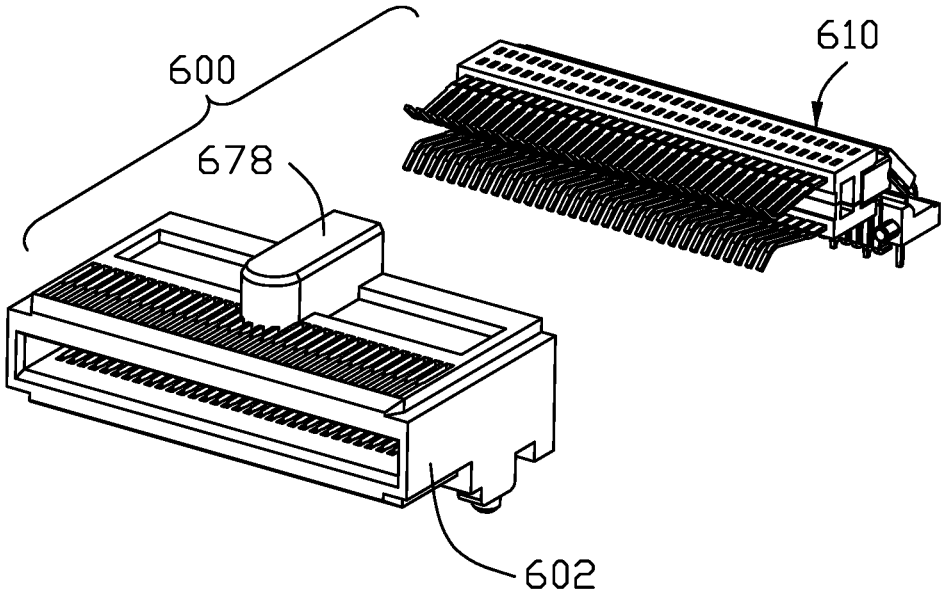
FIG. 28 is an exploded perspective view of the electrical receptacle of FIG. 27.
Figure 29A:
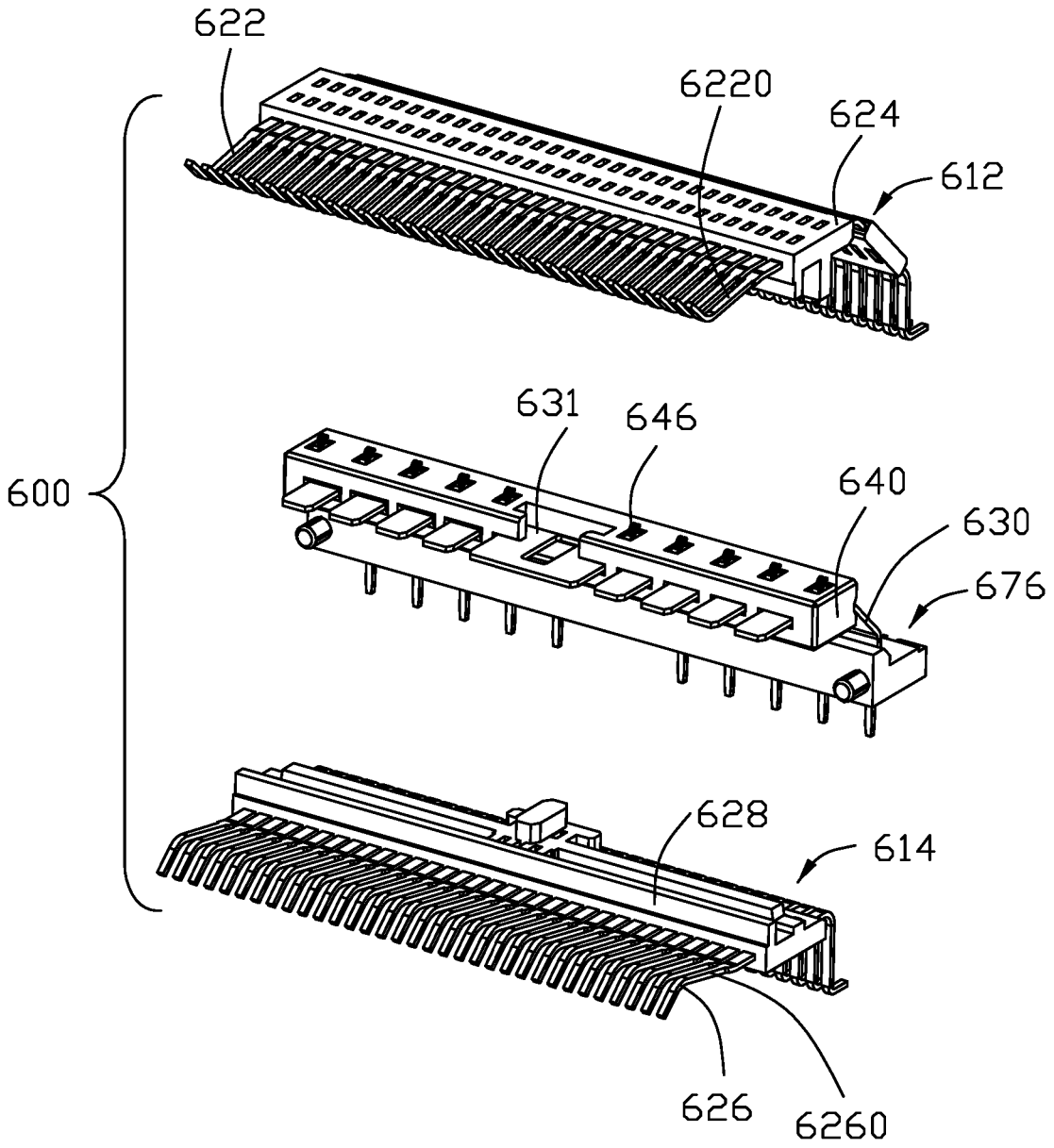
FIG. 29(A) is a front exploded perspective view of the terminal module of the electrical receptacle of FIG. 28.
Figure 29B:
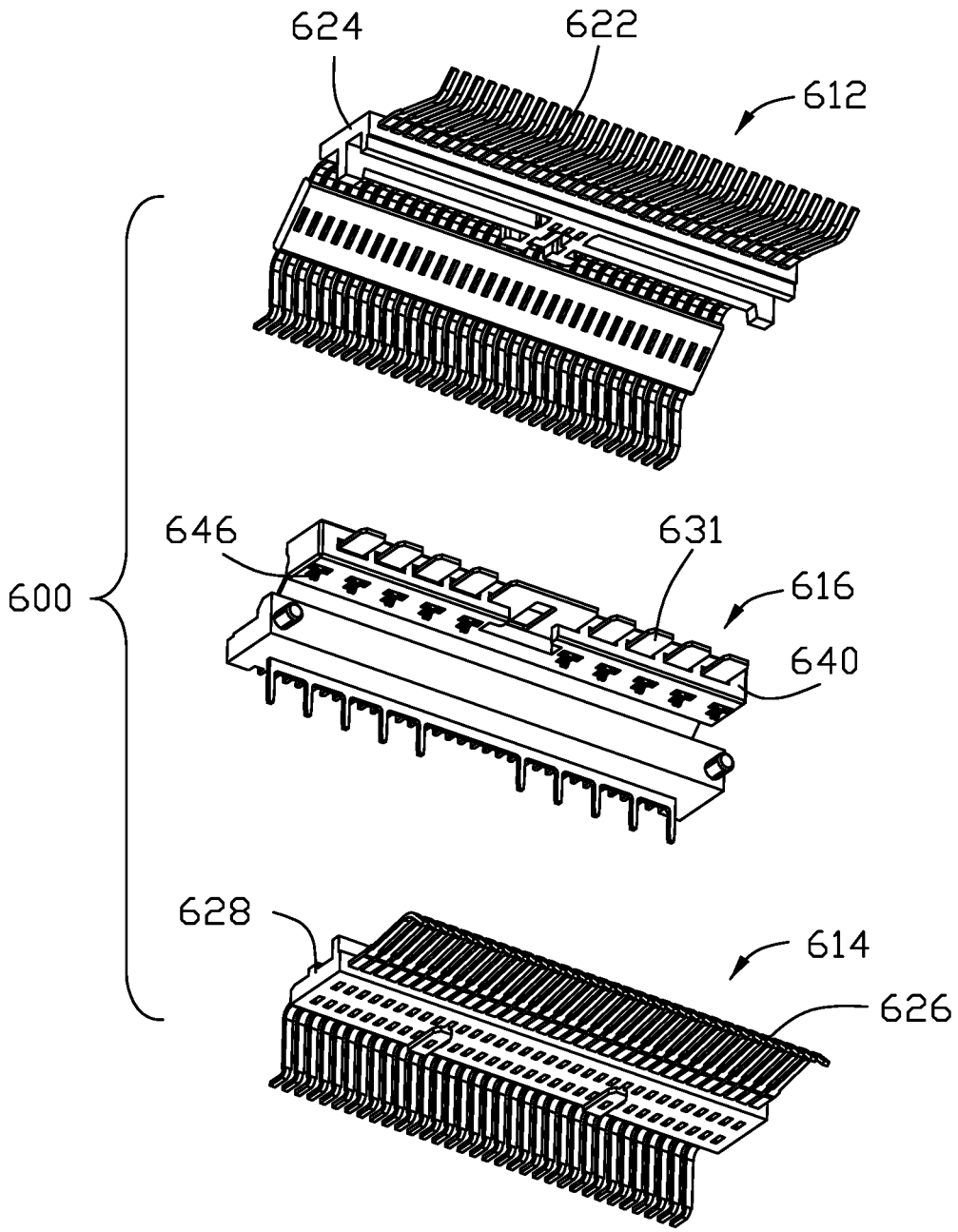
FIG. 29(B) is a rear exploded perspective view of the terminal module of the electrical receptacle of FIG. 28.
Figure 30A:
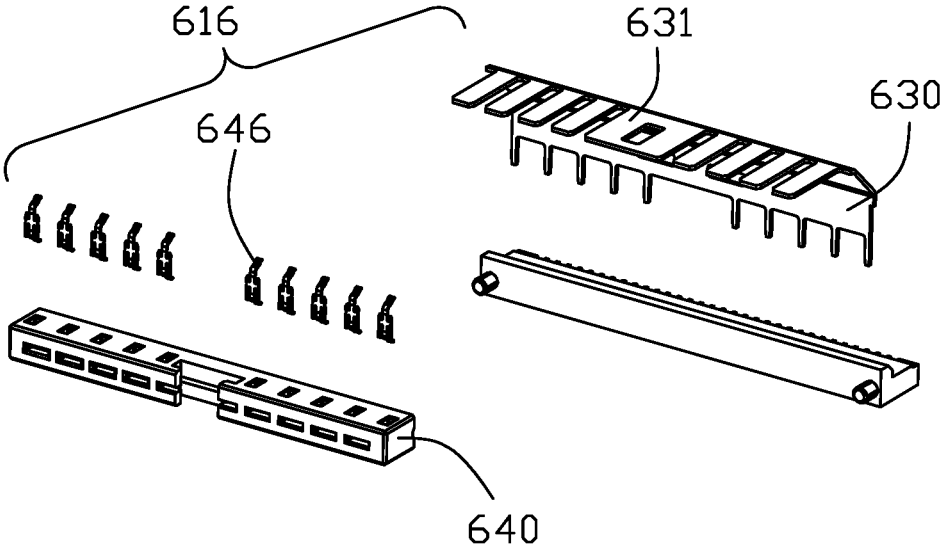
FIG. 30(A) is a front exploded perspective view of the grounding part of the terminal module of FIG. 29(A)
Figure 30B:
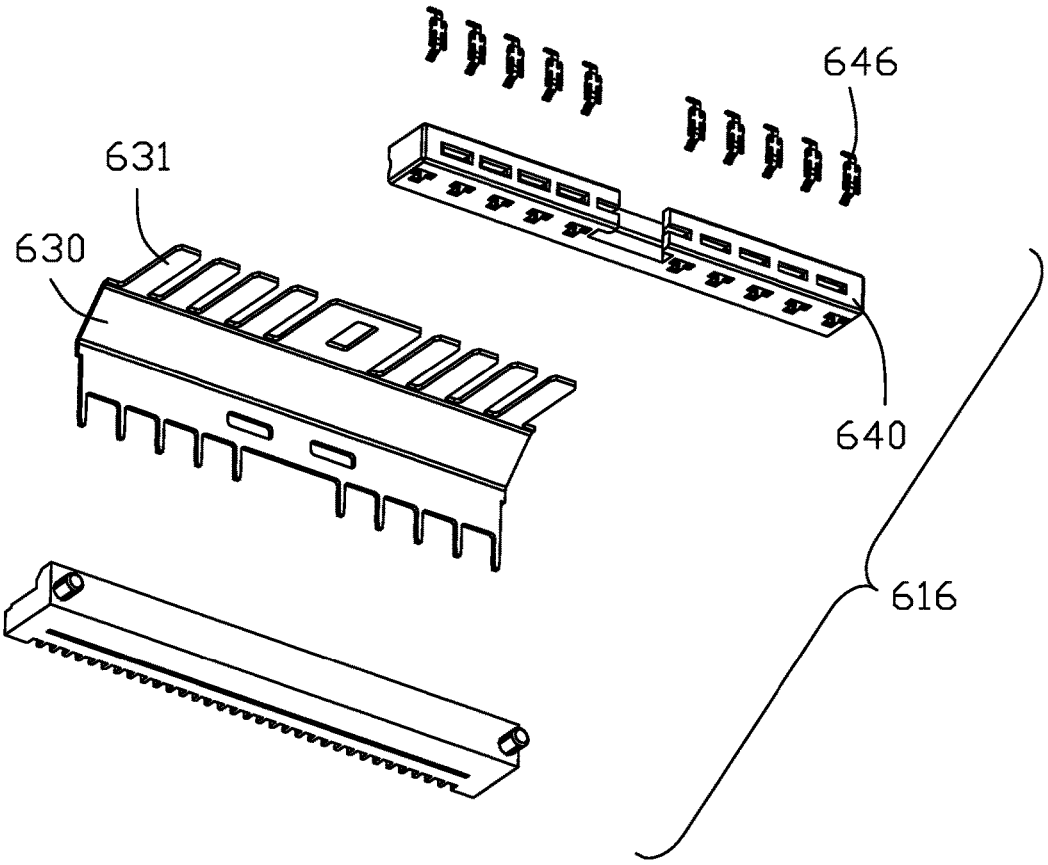
FIG. 30(B) is a rear exploded perspective view of the grounding part of the terminal module of FIG. 29(B)
Figure 31:
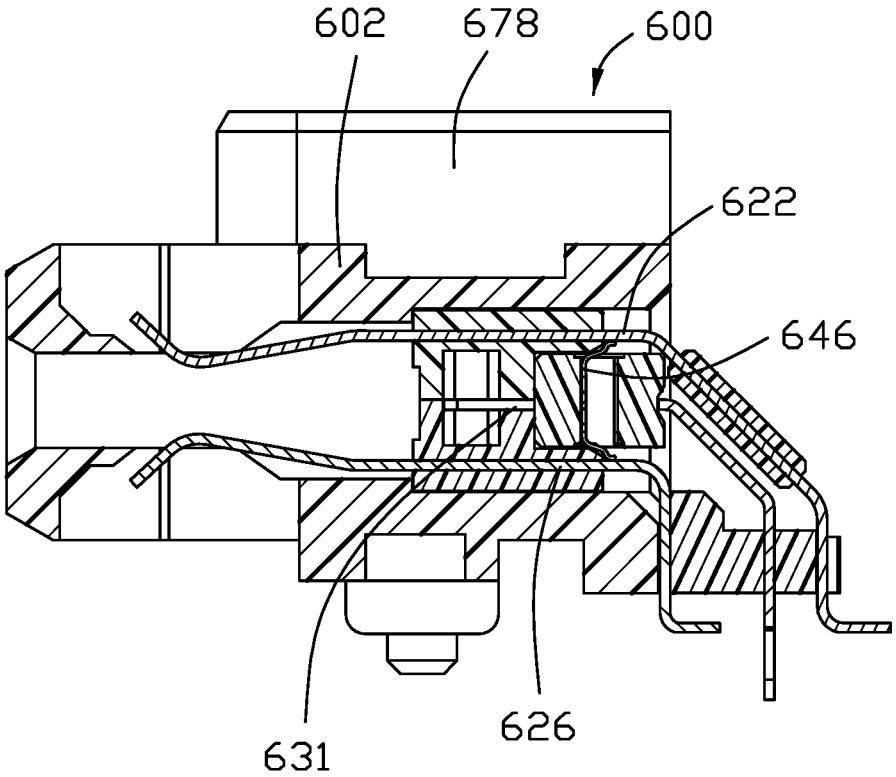
FIG. 31 is a cross-sectional view of the electrical receptacle of FIG. 26(A).

FIGS. 8-18 show a second embodiment of the electrical connector 800 wherein in comparison with the first embodiment, an additional common ground contact sub-assembly 840 is assembled upon the shielding plate 830 to establish the mechanically and electrically connection between the shield plate 830 and the upper ground terminals 8220 and the lower ground terminals 8260. The contact sub-assembly 840 includes an insulator 842 forming a plurality of vertical passageways 844 to receive a plurality of contacts 846 therein. Each contacts 846 is essentially a bifurcated dual beam structure including opposite upper and lower beams 848/849 extending beyond the insulator 842 to electrically and mechanically contact the corresponding ground terminals 8220, 8260 of the corresponding upper terminal 822 and the lower terminal 826, respectively. The upper insulator 824 defines a plurality of through holes 8120 for the upper beams 848 extending through to mechanically and electrically connect upper ground terminals 8220, respectively. The lower insulator 828 defines a plurality of through holes 8140 for the lower beams 849 extending through to mechanically and electrically connect lower ground terminals 8260, respectively. The insulator 842 further includes a plurality of horizontal passages 850 alternately arranged with the vertical passageways 844. The shielding plate 830 forms a plurality of blades 831 received within the corresponding horizontal passages 850 to sidewardly contact the corresponding contacts 846. Under this situation, a grounding path is established among the ground terminal 8220, 8260 of the upper terminal module 812 and the lower terminal module 814, the upper and lower beams 848/849 of the contacts 846, the blades 831 of the shielding plate 830 to the printed circuit board (not shown) on which the receptacle connector 800 is mounted. FIG. 10 shows the grounding fingers 819, 821 of the upper metallic ground plate 818 and the lower metallic ground plate 820 connected with the ground terminals 8220, 8260 of the corresponding upper terminal module 812 and the lower terminal module 814 with the plug connector removed for clear illustration. Therefore, the upper and lower metallic ground plate 818, 820, the upper and lower ground terminal 8220, 8260, the contact sub-assembly 840, and the shielding plate 830 are grounding connected together.

FIGS. 19-25 show a third embodiment of the electrical connector 700 wherein in comparison with the electrical connector 800 of the second embodiment, the common ground contact sub-assembly is replaced with a pair of FPCs 770 (Flexible Printed circuits) with the corresponding grounding circuit traces 771 thereon to respectively electrically and mechanically contact, via soldering or compression, the shielding plate 730 and the ground terminals 7220, 7260 of the upper terminal module 712 and the lower terminal module 714.

Referring to FIGS. 26(A) to 31, show a fourth embodiment of the electrical connector 600. The receptacle 600 includes an insulative housing 602 enclosing a terminal module sub-assembly 610. The terminal module sub-assembly 610 includes an upper terminal module 612, which includes a plurality of upper terminals 622 integrally formed with an upper insulator 624, and a lower terminal module 614, which includes a plurality of lower terminals 626 integrally formed with a lower insulator 628, to commonly sandwich therebetween a grounding part module 616, which includes a metallic shielding plate 630 associated with a plurality of grounding contacts 646 within a middle insulator 640, in the vertical direction wherein the grounding contacts 646 further contact the selected ground terminals 6220, 6260 of the upper terminals 622 and those of the lower terminals 626 for shorting those selected ground terminals 6220, 6260 to the shielding plate 630. The terminal module sub-assembly 610 may be referred to the second embodiment. The insulative housing 602 further forms a protrusion 678 to be received within a notch in a mating connector for anti-mismating.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

an insulative housing defining a front cavity for receiving a plug and a rear cavity opposite to said front cavity in a front-to-back direction;

a terminal assembly assembled in the rear cavity and including an upper terminal module, a lower terminal module, and a shielding module sandwiched therebetween in a vertical direction perpendicular to said front-to-back direction, said upper terminal module including a plurality of upper terminals integrally formed with an upper insulator, said upper terminals comprising a pair of upper ground terminals and a pair of upper differential signal terminals disposed between the pair of upper ground terminals, said lower terminal module including a plurality of lower terminals integrally formed with a lower insulator, said lower terminals comprising a pair of lower ground terminals and a pair of lower differential signal terminals disposed between the pair of lower ground terminals, said shielding module including at least one metallic shielding plate; wherein a ground member is associated with the shielding module to mechanically and electrically connect at least one of the upper ground terminals and the lower ground terminals with the shielding plate.

2. The electrical connector as claimed in claim 1, wherein the ground member is mechanically and electrically connected all of the upper ground terminals and the lower ground terminals with the shielding plate.

3. The electrical connector as claimed in claim 2, wherein said ground member is assembled with the shielding module to establish the mechanically and electrically connection between the shield plate and the upper ground terminals and the lower ground terminals.

4. The electrical connector as claimed in claim 3, wherein the ground member comprises an insulator and a plurality of contacts received in the insulator, each of the contacts comprising an upper beam and a lower beam opposite to the upper beam and both of them extending beyond the insulator to mechanically and electrically connect upper ground terminal and the lower ground terminal, respectively.

5. The electrical connector as claimed in claim 4, wherein the insulator defines a plurality of horizontal passages, and the shield plate comprised a plurality of blades received in the horizontal passages to mechanically and electrically connect the contacts.

6. The electrical connector as claimed in claim 5, wherein the insulator defines a plurality of vertical passageways for receiving the contacts, the horizontal passages alternately arranged with the vertical passageways, the blades received within the corresponding horizontal passages sidewardly contacted the corresponding contacts.

7. The electrical connector as claimed in claim 4, wherein the upper insulator and the lower insulator defines a plurality of through holes for the upper beams and a lower beams extending through to mechanically and electrically connect upper ground terminals and the lower ground terminals, respectively.

8. The electrical connector as claimed in claim 4, wherein at least one of the upper beam and a lower beam is a bifurcated dual beam structure.

9. The electrical connector as claimed in claim 2, wherein the ground member comprises a pair of flexible printed circuits, one of the flexible printed circuits mechanically and electrically connected the upper ground terminals with the shielding plate, the other flexible printed circuit mechanically and electrically connected the lower ground terminals with the shielding plate.

10. The electrical connector as claimed in claim 2, further comprising an upper metallic ground plate located upon an upper surface of the housing, the upper metallic ground plate comprising a plurality of fingers extending into the front cavity of the housing.

11. The electrical connector as claimed in claim 10, further comprising a lower metallic ground plate located upon a bottom surface of the housing, the lower metallic ground plate comprising a plurality of fingers extending into the front cavity of the housing.

12. The electrical connector as claimed in claim 11, wherein the spring fingers of the upper and lower metallic ground plate are mechanically and electrically connected to the upper ground terminals and the lower ground terminals respectively when the plug is inserted into the front cavity of the housing.

13. The electrical connector as claimed in claim 12, wherein the housing defines a plurality of slots extending through an upper and a bottom wall for the fingers of the upper and the lower metallic ground plate extending into the front cavity of the housing.

14. The electrical connector as claimed in claim 1, wherein each of the upper and the lower ground terminals comprises a front free end longer than each of a front free end of the upper and the lower differential signal terminals.

15. The electrical connector as claimed in claim 1, wherein each of the upper and the lower terminals comprises a tail portion extending downwardly and beyond a bottom surface of the housing for being surface mounted on a printed circuit board, and the metallic shielding plate comprises a plurality shielding tail extending downwardly and beyond a top surface of the tail portions for being mounted on the printed circuit board by through hole manner.

16. An electrical connector for mounting to a printed circuit board, comprising:

an insulative housing defining a front cavity for receiving a plug and rear cavity opposite to said front cavity in a front-to-back direction; and a terminal assembly assembled in the rear cavity and including an upper terminal module, a lower terminal module, and a shielding module sandwiched therebetween in a vertical direction perpendicular to said front-to-back direction, said upper terminal module including a plurality of upper terminals integrally formed with an upper insulator, said upper terminals comprising upper ground terminals and upper differential signal terminals, said lower terminal module including a plurality of lower terminals integrally formed with a lower insulator, said lower terminals comprising lower ground terminals and lower differential signal terminals, said shielding module including a metallic shielding plate integrally formed with a middle insulator; wherein a grounding member is associated with the shielding module to common both the upper ground terminals and the lower ground terminals to the shielding plate; wherein the middle insulator aligns tails of the upper terminals in position for surface mounting to the printed circuit board.

17. The electrical connector as claimed in claim 16, wherein said middle insulator includes securing mechanism to directly fix to the housing.

18. The electrical connector as claimed in claim 16, wherein said middle insulator further align tails of the lower terminals in position for surface mounting to the printed circuit board.

19. An electrical connector for mounting to a printed circuit board, comprising:

an insulative housing defining a front cavity for receiving a plug and rear cavity opposite to said front cavity in a front-to-back direction;

a terminal assembly assembled in the rear cavity and including an upper terminal module, a lower terminal module, and a shielding module sandwiched therebetween in a vertical direction perpendicular to said front-to-back direction, said upper terminal module including a plurality of upper terminals integrally formed with an upper insulator, said upper terminals comprising upper ground terminals and upper differential signal terminals, said lower terminal module including a plurality of lower terminals integrally formed with a lower insulator, said lower terminals comprising lower ground terminals and lower differential signal terminals, said shielding module including a metallic shielding plate; wherein a grounding member is associated with the shielding module to contact immovable retaining sections of both the upper ground terminals and the lower ground terminals to the shielding plate; wherein at least one shielding/grounding plate is attached to the housing around the front cavity and includes a plurality of grounding fingers extending into the front cavity so as to respectively contact moveable contacting sections of at least either the upper ground terminals or the lower ground terminals when a module is inserted into the front cavity between the upper terminals and the lower terminals thereby resulting in two grounding points for the corresponding upper ground terminal or lower ground terminal.

20. The electrical connector as claimed in claim 19, wherein said grounding fingers support the moveable contacting sections of the corresponding terminals in the vertical direction.

* * * * *